US006137977A

United States Patent [19]

Okado et al.

[11] Patent Number: 6,137,977

[45] Date of Patent: Oct. 24, 2000

[54] IMAGE FORMING METHOD AND IMAGE FORMING APPARATUS USING SPECIFIC DEVELOPER COMPOSITION

[75] Inventors: Kenji Okado, Yokohama; Ryoichi Fujita, Odawara; Masanori Shida, Shizuoka-ken; Kazumi Yoshizaki, Mishima, all of Japan

[73] Assignee: Canon Kabushiki Kaisha

[21] Appl. No.: 09/099,136

[22] Filed: Jun. 18, 1998

[30] Foreign Application Priority Data

Jun. 18, 1997 [JP] Japan ..... 9-160791

[51] Int. Cl.[7] ..... G03G 15/08

[52] U.S. Cl. ..... 399/252; 430/110; 430/111

[58] Field of Search ..... 399/252; 430/108, 430/109, 111

[56] References Cited

U.S. PATENT DOCUMENTS

| | | | |
|---|---|---|---|
| 4,321,886 | 3/1982 | Azuma | 118/689 |
| 5,422,214 | 6/1995 | Akiyama et al. | 430/106.6 |
| 5,467,174 | 11/1995 | Koga | 399/285 |
| 5,512,402 | 4/1996 | Okado et al. | 430/106.6 |
| 5,547,797 | 8/1996 | Anno et al. | 430/106.6 |
| 5,637,432 | 6/1997 | Okado et al. | 430/110 |
| 5,670,288 | 9/1997 | Okado et al. | 430/122 |
| 5,712,073 | 1/1998 | Katada et al. | 430/120 |
| 5,774,771 | 6/1998 | Kukimoto et al. | 399/223 |
| 5,827,632 | 10/1998 | Inaba et al. | 430/111 |
| 5,853,938 | 12/1998 | Nakazawa et al. | 430/110 |

FOREIGN PATENT DOCUMENTS

| | | | |
|---|---|---|---|
| 0791861 | 8/1997 | European Pat. Off. | G03G 13/08 |
| 32060 | 3/1980 | Japan . | |
| 165082 | 9/1984 | Japan . | |
| 124677 | 4/1992 | Japan . | |

*Primary Examiner*—Robert Beatty
*Attorney, Agent, or Firm*—Fitzpatrick, Cella, Harper & Scinto

[57] ABSTRACT

In the image forming machine of the invention, a two-component type developer has a spherical magnetic powder dispersion type carrier, which has a weight average particle diameter of from 15 to 60 μm. The external additive is present in the form of particles on the toner particle, and comprises inorganic oxide fine particles A having a shape factor SF-1 of from 100 to 130, and non-spherical inorganic oxide fine particles B, having a shape factor SF-1 larger than 150 and particles B having been obtained by combining a plurality of component particles.

84 Claims, 6 Drawing Sheets

IMAGE FORMING METHOD AND IMAGE FORMING APPARATUS USING SPECIFIC DEVELOPER COMPOSITION

BACKGROUND OF THE INVENTION

1. Field of the Invention

The present invention relates to an image forming method and an image forming apparatus applicable for developing an electric latent image or a magnetic latent image. More particularly, the invention relates to an image forming method and an image forming apparatus apprawhich improves the service life of a developer and gives a stable image concentration.

2. Description of the Related Art

There is conventionally known a method of converting an electrostatic latent image into a sensible image by bearing a dry type developer serving as an image developing agent on the surface of a developer bearing member, transferring and supplying the developer to the proximity of the surface of a latent image bearing member bearing an electrostatic latent image, and developing the electrostatic latent image while applying an alternate electric field between the latent image bearing member and the developer bearing member.

The aforesaid developer bearing member, often taking the form of a developing sleeve, will hereinafter be referred to as the "developing sleeve", and the latent image bearing member, often implemented in the form of a photosensitive drum, will hereinafter be called the "photosensitive drum".

A conventionally known method of development includes those called the magnetic brush developing processes (for example, disclosed in Japanese Patent Laid-Open No. 55-32,060 and No. 59-165,082) comprising the steps of forming a magnetic brush on the surface of a developing sleeve having a magnet arranged therein, using a two-component type developer consisting of, for example, magnetic carrier particles and non-magnetic toner particles, bringing this magnetic brush into sliding contact with, or near, a photosensitive drum arranged opposite thereto with a slight development gap in between, and applying continuously an alternate electric field between the developing sleeve and the photosensitive drum, thereby causing displacement and reverse displacement of toner particles from the developing sleeve side to the photosensitive drum side. In the foregoing two-component magnetic brush developing process, toner in an amount corresponding to the amount of toner consumed by development is supplied, thereby keeping a constant mixing ratio of toner particles to magnetic carrier (hereinafter simply referred to as the "T/C ratio"). Various techniques have conventionally been proposed for the detection of the T/C ratio in the developing vessel. A technique, for example, comprises the steps of providing detecting means around a photosensitive drum, irradiating a light onto toner having displaced from the side of a developing sleeve to the photosensitive drum side, and determining a T/C ratio from the transmitting light and the reflected light at this point; one comprising the steps of providing detecting means on a developing sleeve, and determining a T/C ratio from the reflected light when irradiating a light onto a developer coated on the developing sleeve; and another one comprising the steps of providing a sensor in a developing vessel, detecting a change in magnetic permeability ($\mu$) of a developer within a certain volume near the sensor by the utilization of coil inductance, thereby determining a T/C ratio. These techniques have been proposed and practically applied.

However, the technique of detecting the T/C ratio from the amount of toner on the photosensitive drum has a problem in that, along with the recent downsizing tendency of copying machines and image forming apparatus, a space for installing detecting means cannot be ensured. The one for detecting the T/C ratio from the reflected light upon irradiating the light to the developer coated on the developing sleeve is defective in that, when detecting means is stained by toner splash or the like, the T/C ratio cannot accurately be detected. In contrast, in the technique of detecting a change in magnetic permeability ($\mu$) of the developer within a certain volume near the sensor by the utilization of the coil inductance to determine the T/C ratio (hereinafter referred to as the "toner concentration detecting sensor"), the sensor alone is available at a low cost, and the machine is free from the problems of installation space or stain by toner splash. In a copying machine or an image forming apparatus having only a limited space for installation, of a low cost, this would be the optimum T/C ratio detecting means.

In the toner concentration detecting sensor using a change in magnetic permeability of the developer, a larger magnetic permeability means a decrease in T/C in the developer within a certain volume, and hence a decrease in the amount of toner in the developer. Supply of toner is therefore started. A smaller magnetic permeability means, on the other hand, a higher T/C in the developer within a certain volume, and hence an increase in the amount of toner in the developer. Supply of toner is therefore discontinued. T/C is thus controlled in accordance with such a sequence.

In the toner concentration detecting sensor detecting a change in magnetic permeability ($\mu$) of the developer within a certain volume as described above, however, a change in bulk density of the developer itself under the effect of some cause or other leads to a change in magnetic permeability of the developer. This is associated with a defect of this sensor in that the sensor output shows a change corresponding to the change in magnetic permeability. In other words, a change in bulk density in the developing vessel in spite of a constant T/C in the developing vessel results in a change in the amount of the developer (carrier) within the certain volume near the toner concentration detecting sensor. The change in magnetic permeability therefore inevitably results in a change in the sensor output. As a result, a sensor output showing a decrease in the amount of toner is issued although toner is not consumed, and toner is supplied. Or, although the amount of toner decreases, a sensor output showing no decrease in toner is issued, and toner is not supplied. The former case poses problems of the image density increased by the over-supply of toner, overflow of the developer from the developing vessel as a result of increase in the amount of developer brought about by the increase in the amount of toner, and toner splash caused by a decrease in the charge amount of toner along with the increase in toner ratio in the developer. The latter case causes, on the other hand, image deterioration or a lower image density resulting from the decrease in the amount of toner in the developer, or a lower image density resulting from an increase in the charge amount of toner.

A detailed study carried out by the present inventors revealed that these problems were caused mainly the following three phenomena in the system comprising the developing machine and the developer used in the foregoing developing process.

The first phenomenon is caused by crushed toner conventionally used in common. Since individual particles of crushed toner have irregular surfaces and are different from each other, bulk density of the developer tends to vary between states thereof including stationary, flowing and holding states. Variation of bulk density caused by a change in the toner shape through use for a long period of time is particularly large.

The second phenomenon is caused by a configuration in which, in order to prevent non-uniform coating of the developer on the developing sleeve, the developer is accumulated in the proximity of the regulating blade of the developing sleeve to compress the developer. In this configuration, the developer is slowly compressed mechanically and magnetically, resulting in a change in toner shape which in turn leads to a change in bulk density of the developer, or in a change in bulk density caused by buried external additive, and these changes cause changes in magnetic permeability of the developer.

The third phenomenon is a problem regarding a change in charge amount of toner in the rotation of the developing sleeve. Because the developer is liable to be compressed in a developer sump near the regulating blade of the developing sleeve as described above, there is an increase in frictional force between particles of developer along with the rotation of the developing sleeve. According as the developing sleeve rotates more times, the external additive on the toner tends to transfer to the carrier more easily, thus resulting in a larger change in toner charge amount. A larger change in toner charge amount suggests a larger change in repulsion between particles of the developer. A larger toner charge amount causes a stronger repulsion between developer particles, and a resultant larger distance between particles of the developer in turn causes a decrease in bulk density of the developer. Since bulk density of the developer largely varies under the effect of these three phenomena, it has been difficult with the conventional configuration of developing machine and developer to fully utilize a toner concentration detecting sensor based on the change in magnetic permeability.

SUMMARY OF THE INVENTION

An object of the present invention is to provide an image forming method and an image forming apparatus which permits accurate toner concentration control for a long period of time.

Another object of the present invention is to provide a low-cost image forming apparatus.

Still another object of the present invention is to provide a compact image forming apparatus.

A further object of the present invention is to provide an image forming method, comprising a charging step of applying charge to a latent image bearing member; a latent image forming step of forming an electrostatic latent image on said charged latent image bearing member; a developing step of developing the electrostatic latent image by a developing means having a developer bearing member which bears and transfers a two-component type developer opposite to said latent image bearing member, and a magnetic field generator fixedly provided in said developer bearing member; and a controlling step of controlling a toner concentration of the two-component type developer by detecting a change in magnetic permeability of said two-component type developer by the use of inductance of a coil; wherein said two-component type developer has a spherical magnetic powder dispersion type carrier in which at least a magnetic powder is dispersed in a binder resin, and a non-magnetic toner in which an external additive adheres to the surface of non-magnetic toner particles; said spherical magnetic powder dispersion type carrier has a weight average particle diameter of from 15 to 60 $\mu$m; said non-magnetic toner particles have a weight average particle diameter of from 2 to 9 $\mu$m; said external additive is present on the toner particles in the form of primary particles or secondary particles and comprises (i) inorganic oxide fine particles A having a shape factor SF-1 of from 100 to 130 and (ii) non-spherical inorganic oxide fine particles B having a shape factor SF-1 larger than 150 and having been obtained by combining a plurality of particles.

A still further object of the present invention is to provide an image forming apparatus, comprising a latent image bearing member for bearing an electrostatic latent image; charging means for applying charge to said latent image bearing member; exposure means for forming an electrostatic latent image on said charged latent image bearing member; developing means for developing said electrostatic latent image, having a developer bearing member for bearing and transferring a two-component type developer, opposite to said latent image bearing member, and a magnetic field generator fixedly provided in said developer bearing member; and toner concentration controlling means for controlling the toner concentration by detecting a change in magnetic permeability of said two-component type developer by the use of inductance of a coil; wherein said two-component type developer has a spherical magnetic powder dispersion type carrier in which at least a magnetic powder is dispersed in a binder resin, and a non-magnetic toner in which an external additive adheres to the surface of said non-magnetic toner particles; said spherical magnetic powder dispersion type carrier has a weight average particle diameter of from 15 to 60 $\mu$m; said non-magnetic toner particles have a weight average particle diameter of from 2 to 9 $\mu$m; said external additive is present on the toner particles in the form of primary particles or secondary particles and comprises (i) inorganic oxide fine particles A having a shape factor SF-1 of from 100 to 130 and (ii) non-spherical inorganic oxide fine particles B having a shape factor SF-1 larger than 150 and having been obtained by combining a plurality of particles.

DESCRIPTION OF THE PREFERRED EMBODIMENTS

Figure 1:
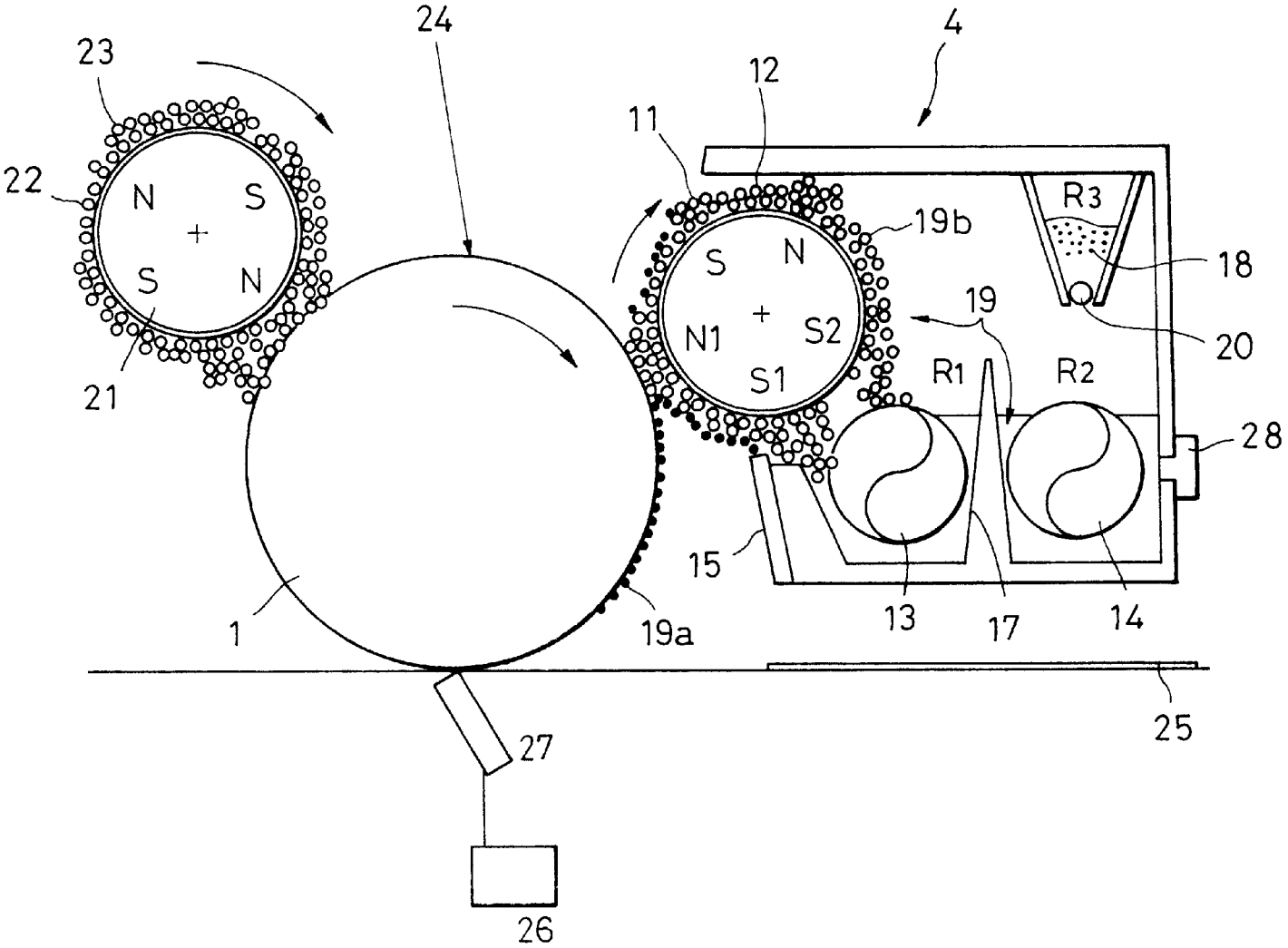
FIG. 1 is a schematic view illustrating a typical embodiment of the image forming apparatus of the present invention.

In the present invention, a change in bulk density of the developer is reduced and stability of toner concentration control is improved by using a magnetic powder dispersion type carrier and a developer comprising non-magnetic toner to the surface of which two different kinds of external additive adhere. Further, in the invention, particularly when using a spherical magnetic powder dispersion type carrier prepared by the polymerization process, it is possible to reduce changes in bulk density of the developer and improve stability of toner concentration control without a change in fluidity of the carrier for a long period of time.

Any of toner particles prepared by the pulverization process and ones prepared by the polymerization process may be used in the invention. Toner particles prepared by the polymerization process, particularly by the suspension polymerization process are preferably used. The seed polymerization process comprising causing polymer particles once obtained to further adsorb a monomer, and them causing polymerization by the use of a polymerization starting agent is appropriately applicable in the present invention.

In the preparation of toner particles by the pulverization process, toner particles are obtained by sufficiently mixing component materials such as a binder resin, a coloring agent, and a charge control agent in a ball mill or other mixing machine, well kneading the mixture by the use of a heat-kneading machine such as a heat roll kneader and an extruder, and after cooling and solidification, applying pulverization by a mechanical means and then classification. Toner particles should preferably be subjected, after classification, to a spheroidizing treatment by hot blast treatment.

The kinds of binder resin applicable in the preparation of toner particles based on the pulverization process include homopolymers of styrene and substitutions thereof such as polystyrene, poly-p-chlorostyrene and polyvinyltoluene; styrene-based copolymers such as styrene-p-chlorostyrene copolymer, styrene-vinyltoluene copolymer, styrene-vinylnaphthalene copolymer, styrene-ester acrylate copolymer, styrene-ester methacrylate copolymer, styrene-α-methyl chloromethacrylate copolymer, styrene-acrylonitrile copolymer, styrene-vinylmethylether copolymer, styrene-vinylethylether copolymer, styrene-vinylmethylketone copolymer, styrene-butadiene copolymer, styrene-isoprene copolymer, and styrene-acrylonitrile-indene copolymer; polyvinyl chloride, phenol resin, natural and denatured phenol resins, natural resin denatured maleic resin, acrylic resin, methacrylic resin, polyvinyl acetate, silicone resin, polyester resin, polyurethane, polyamide resin, furan resin, epoxy resin, xylene resin, polyvinylbutylal, terpene resin, cumarone-indene resin, and petroleum resins. Cross-linked styrene resins are also preferable binder resins.

Applicable commoners used to a styrene monomer a styrene-based copolymer include, for example, monocarboxylic acids and substitutes thereof having a double bond such as acrylic acid, methyl acrylate, ethyl acrylate, butyl acrylate, dodecyl acrylate, octyl acrylate, acrylic acide-2-ethyhexyl, phenyl acrylate, methacrylic acid, methyl methacrylate, ethyl methacrylate, butyl methacrylate, octyl methacrylate, acrylonitrile, methacrylonitrile, and acrylamide; dicarboxylic acids and substitutes thereof such as maleic acid, butyl maleiate and dimethyl maleiate; vinylesters such as vinyl chloride, vinyl acetate, and vinyl benzoate; ethylene-based olefins such as ethylene, propylene and butylene; vinyl ketones such as vinylmethylketone, and vinylhexylketone; and vinylethers such as vinylmethylether, vinylethylether, and vinylisobutylether, used alone or in combination. A compound having mainly at least two polymerizable double bonds is used as a cross-linking agent. Applicable compounds include, for example, aromatic divinyl compounds such as divinylbenzene, and divinylnaphthalene; esters carboxylate having two double bonds such as ethyleneglycoldiacrylate, ethylenebglycoldimethacrylate, and 1,3-butanedioldimethacrylate; divinyl compounds such as divinylaniline, divinylether, divinylsulfide, and divinylsufon; and compounds having three or more vinyl groups, used alone or in combination. It is particularly preferable to add a polar resin such as a copolymer of styrene and (meth)acrylic acid, maleic acid copolymer, or saturated polyester resin.

Toner particles prepared by the polymerization process have a sharper particle diameter distribution as compared with pulverized toner particles and have a spherical shape closer to a true sphere, showing a slight change in shape after use for a long period of time, with a smaller change in bulk density. Pulverized toner particles suffer a serious change in shape because irregular surfaces are ground off by friction resulting from contact between toner particles, bringing the shape of particle to a sphere. Polymerized toner particles, having an original shape closer to a true sphere, suffer a smaller change in bulk density since there are a fewer factors causing a change in shape.

When the polymerization is employed as the production process for the toner particles, the toner particles can be specifically produced by a production process as described below. A monomer composition comprising monomers and stripping agent of a low-softening point material and a colorant added therein, a charge control agent, a polymerization initiator and additives, which are uniformly dissolved or dispersed by means of a dispersion machine such as a homogenizer or an ultrasonic dispersion machine, is dispersed in an aqueous medium containing a dispersant, by means of a dispersion machine such as a conventional stirrer, homomixer or homogenizer. Granulation is carried out preferably while controlling stirring conditions such as stirring speed and stirring time so that droplets comprised of the monomer composition can have the desired toner particle size. After the granulation, stirring may be carried out to such an extent that the state of particles is maintained and the particles can be prevented from settling, by the action of the dispersant. The polymerization temperature set at 40° C. or above, usually from 50 to 90° C. At the latter half of the polymerization reaction, the temperature may be elevated, and the aqueous medium may be removed in part at the latter half of the reaction or after the reaction has been completed, in order to remove unreacted polymerizable monomers, by-products and so forth, for the purpose of improving the running durability in the image forming method of the present invention. After the reaction has been completed, the toner particles formed are collected by washing and filtration, followed by drying. In the case of suspension polymerization, water may preferably be used as the dispersion medium usually in an amount of from 300 to 3,000 parts by weight relative to 100 parts by weight of the monomer composition.

In the present invention, a toner having a core/shell structure in which a low-softening-point material is coated with a shell resin should preferably be used. The function of the core/shell structure is to impart blocking resistance to the toner without impairing an excellent fixability of the toner, and as compared with a polymerized toner as a bulk not having a core, polymerization of only the shell portion permits easier removal of residual monomers in a port-treatment step after polymerization.

A toner having a core/shell structure is available by setting a smaller polarity for the material in the aqueous medium for the low-softening-point material then for the main monomers.

The main component of the core should preferably be a low-softening-point material, a compound showing a main maximum peak value as measured in accordance with ASTM D3418-8 of from 40 to 90° C. A maximum peak value of under 40° C. leads to a poorer self-aggregating ability of the low-softening-point material, resulting in a lower high-temperature offset resistance. A maximum peak value of over 90° C. leads to a higher fixing temperature. When preparing by direct polymerization, in which granulation and polymerization are accomplished in an aqueous system, a high temperature of maximum peak value causes separation of the low-softening-point material mainly during granulation, thus disturbing suspension system.

A DSC-7 manufactured by Perkin-Elmer Co. is used for the measurement of temperature of maximum peak value in the invention. Temperature correction of the machine detecting section is accomplished by acting on melting points of indium and zinc, and the melting heat of indium is utilized for correcting the calorific value. An aluminum pan is used as a sample, with-a vacant pan set for reference, and measurement is carried out at a heating rate of 10° C./min.

More specifically, applicable materials include paraffin wax, microcrystalline wax, polyolifin wax, Fischer-Tropsch wax, carnoubic wax, amide wax, alcohol, higher fatty acid, acid amide wax, ester wax, ketone, hardened caster oil, vegetable, animal and mineral wax, petrolactun, derivatives thereof and graft/block compounds thereof.

The low-softening-point material should preferably be added in an amount of from 5 to 30% by weight on the basis of toner particles. Addition of under 5% by weight increases the burden for removal of residual monomers as described above, and addition of over 30% by weight leads to easy occurrence of combination between toner particles during granulating in the preparation based on the polymerization process and easier production of toner having a broad particle size distribution, thus showing inappropriateness in the invention.

As a shell resin forming the shell section, preferable materials include popularly used styrene-(meth)acrylic copolymer, polyester resin, epoxy resin and styrene-butadiene copolymer. Preferable monomers for obtaining a styrene-based copolymer include styrene-based monomers such as styrene, o-(m-, p-)methylstyrene, m-(p-)ethystyrene; ester (meth) acrylate-based monomers such as methyl (meth) acrylate, ethyl (meth) acrylat, propyl (meth) acrylate, butyl (meth) acrylate, octyl (meth) acrylate, dodecyl(meth) acrylate, steacryl (meth) acrylate, behenyl (meth) acrylate, 2-ethylhexyl (meth) acrylate, dimethylaminoethyl (meth) acrylate, and diethylaminoethyl (meth) acrylate; and en-based monomers such as butadiene, isoprene, cyclohexene, (meth) acrylonitrile, and amide acrylate. These resins are employed alone, or generally in appropriate mixture so that the theoretical glass transition temperature (Tg) as specified in the Polymer Handbook, 2nd ed., III-PP, 139–192 (published by John Wiley & Sons) shows a temperature of from 40 to 75° C. A theoretical glass transition temperature of under 40° C. is not desirable because of problems in storage stability of toner and durability of developer. A temperature of over 75° C. should not be selected is terns of the image quality since an elevation of the fixing point occurs, and particularly in the case of a full-color toner, mixing of individual colors is insufficient, leading to a poorer color reproducibility and to a serious deterioration of transparency of an OHP image. The molecular weight of a shell resin is measured by GPC (Gel Permeation Chromatography). More specifically, measurement based on GPC comprises the steps of previously carrying out an extraction of toner in a Soxley extractor by means of a toluene solution, distilling off toluene by a rotary evaporator, conducting washing sufficiently by adding an organic solvent such as chloroform which can dissolve a low-softening-point material, but cannot dissolve a shell resin, dissolving the material into THF (Tetrahydrofuran), passing a solution through a solvent-resistant membrane filter having a pose diameter of 0.3 $\mu$m, and them, measuring the molecular weight distribution by using a 150C made by Waters Co. and a column configuration comprising A801, 802, 803, 804, 805, 806 and 807 made by Showa Denko Co., with reference to a standard testing line of polystyrene resin. The resultant member average molecular weight (Mn) of the resin component should preferably be of from 5,000 to 1,000,000, with a ratio of the weight average molecular weight (Mw) to the number average molecular weight (Mn) (Mw/Mn) of from 2 to 100.

When preparing a toner having a core/shell structure, in the present invention, it is particularly desirable to add a polar resin, apart from the shell resin, so as to cause the shell resin to incorporate a low-softening-point material. Preferable polar resins applicable in the invention include copolymer of styrene and (meth) acrylic acid, maleic acid copolymer, saturated polyester resin, and epoxy resin. It is particularly preferable to select a polar resin not containing, in molecules, a non-saturated group capable of reacting with the shell resin or monomers. When containing a polar resin having a non-saturated group, if any, a cross-linking reaction takes place with the monomer forming the shell resin layer, and particularly for a full-color toner, this results in a very large molecular weight which is unfavorable for mixing four colors of toner.

In the invention, an outermost shell resin layer may further be provided on the surfaces of the toner particles.

The glass transition temperature of the outermost shell resin layer should preferably set at a temperature higher than that of the shell resin layer for further improvement of blocking resistance and should preferably be cross-linked to an extent not impairing fixability. The outermost shell resin layer should preferably contain a polar resin or a charge control agent for improving chargeability.

Applicable process for providing the outermost shell layer are as follows, although they are not limitative:

(1) A process comprising the steps of, in the latter half of the polymerization reaction or after the completion thereof, adding a monomer containing, as required, a polar resin, a charge control agent, and a cross-linking agent dissolved and dispersed in the reaction system, causing polymerized molecules to adsorb the same, and polymerizing the same by adding a polymerization initiator.

(2) A process comprising the steps of, adding emulsified polymerized particles or soap-free polymerized particles comprising a monomer containing, as required, a polar resin, a charge control agent and a cross-linking agent to the reaction system, and fixing the same to the surfaces of the polymerized particles by aggregation, or as required, by heat.

(3) A process comprising the step of fixing mechanically in dry emulsified polymerized particles or soap-free polymerized particles comprising a monomer containing, as required, a polar resin, a charge control agent and a cross-linking agent to the surfaces of the toner particles.

In the invention, the fact that the toner used has a core/shell structure can be confirmed by the following process. A toner is sufficiently dispersed in a cold-hardenable epoxy resin is hardened in an atmosphere at 40° C. for two days. The resultant hardened product it stained with triruthenium tetroxide, or as required, simultaneous using triosmium tetroxide, and a thin flake-shaped sample is cut by the use of a microtome having diamond teeth. The sectional face of the toner was observed on a transmission type electron microscope (TEM) on the cut sample. In the invention, it is desirable to use the triruthenium tetroxide staining process to impart a contrast between materials by the utilization of a slight difference in the degree of crystallization between the low-softening-point material and the shell. The process for incorporating the low-softening-point material comprises more specifically setting a smaller polarity of the low-softening-point material in the aqueous system than that of the main monomers, and adding a resin or a monomer having a larger polarity in a further smaller amount, thus permitting obtaining a toner having a core/shell structured.

A toner having a desired particle size is available through particle size distribution and particle diameter control of toner particles by a process of altering the kind and the amount of addition of a hard-water soluble inorganic salt or a dispersant serving as a protecting colloid or a process of controlling mechanical equipment conditions such as the rotor cricumferential speed, the number of passes, the shape of the stirring blade and other stirring conditions, the shape of the vessel, or the solid content in the aqueous solution.

Preferable binder resins for toner applicable for pressure-fixing include low-molecular-weight polyethylene, low-molecular-weight polypropylene, ethylene-vinyl acetate copolymer, ethylene-ester acrylate copolymer, higher fatty acid, polyamide resin, and polyester resin, used alone or in combination. Particularly when adopting the polymerization process for the preparation of toner particles in the invention, the binder resin should preferably be free from impairment of polymerization and from materials soluble in an aqueous system.

For the purpose of accurately developing fine latent dots for obtaining a high image quality in the invention, the yellow, magenta, cyan and black toner particles should preferably have an average particle diameter of from 2 to 9 μm, and from 3 to 9 μm with a view to preventing fog or splash. With a weight average particle diameter of under 2 μm, a decrease in transfer efficiency results in much toner remaining on the photosensitive member after transfer, and further, non-uniform blurs of the image tend to be caused by fog and defective transfer. Such a toner is not therefore suitably used in the invention. With a weight average particle diameter of over 9 μm, on the other hand, splash is easily caused for a character or a line image.

In the invention, the toner particles should preferably have a shape factor SF-1 of from 100 to 140, and a shape factor SF-2 of from 100 to 120.

A shape factor SF-1 of over 140 brings the toner particle out of the sphere in shape, or an SF-2 of over 120 make the surface irregularities of the toner particles more apparent. Non-spherical toner particles ones having surface irregularities, of which the surfaces are ground off by friction caused by contact with the carrier of between toner particles during stirring, come closer to a sphere in shape, thus resulting in a larger change in shape. The toner particles having a shape factor SF-1 of over 140 or a shape factor SF-2 of over 120 suffer a large change in shape, and hence a large change in bulk density. This tends to cause an inappropriate output of a toner concentration detecting sensor detecting a change in magnetic permeability of a developer by the use of inductance of a coil.

As a charge control agent used in the invention, known ones are applicable. Particularly for a color toner, the charge control agent should preferably be colorless, have a high charging speed of toner, and is capable of keeping stably a constant amount of charging. When adopting the direct polymerization process in the invention, furthermore, a charge control agent free from impairment of polymerization, not containing a component soluble in aqueous system is particularly preferable. More specifically, applicable compounds include metal compounds of salicylic acid, naphthoic acid, and dicarboxylic acid, polymer type compounds having sulfonic acid or carboxylic acid in a side chain thereof, boron compounds, urea compounds, silicon compounds and calixarene as a negative type; and class-four ammonium salt, polymer type compounds having such a class-four ammonium salt, guanidine compounds, and imidazole compounds as a positive type.

The foregoing charge control agent should preferably be employed in the form of fine particles, and in this case, the charge control agent should preferably have a number average particle diameter of up to 2 μm, or particularly, up to 1 μm.

The amount of the charge control agent should preferably be of from 0.05 to 5 parts by weight relative to 100 parts by weight of resin. Addition of the charge control agent is not however an essential requirement in the invention. It is not always necessary for the toner to contain a charge control agent, by utilizing frictional charging with the carrier when adopting the two-component developing process, or by positively employing frictional charging with a blade member or a sleeve member when adopting the non-magnetic single-component blade coating developing process.

When preparing toner particles by the polymerization process in the present invention, applicable polymerization initiators include, for example, azo or diazo type polymerization initiators such as 2,2'-azobis-(2,4-dimethylvaleronitrile), 2,2'-azobisisobutylonitrile, 2,2'-azobis-4-methoxy-2,4-dimethylvaleronitrile and azobisisobutylonitrile; and peroxide type polymerization initiiators such as benzoyl peroxide, methyl ethyl ketone peroxide, disisopropylperoxy carbonate, cumene hydroperoxide, 2,4-dichlorobenzoyl peroxide and luroyl peroxide. The polymerization initiator should preferably be added in an amount of from 0.5 to 20% by weight based on the weight of the monomers, while amount may vary depending upon the intended degree of polymerization. The types of the polymerization initiators may slightly differ depending on the polymerization method, and may be used alone or in combination, making reference to the 10-hour half-life period temperature.

To control the polymerization degree, any known cross-linking agent, chain transfer agent and polymerization inhibitor may further be added. An inorganic oxide or organic compound may be used as a dispersant by dispersing it in an aqueous phase.

Applicable inorganic oxides include, for example, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, magnetic materials and ferrite. Applicable organic compounds include, for example, polyvinyl alcohol, gelatin, methyl cellulose, methyl hydroxypropyl cellulose, ethyl cellulose, carboxymethyl cellulose sodium salt, and starch. Any of these dispersants should preferably be used in an amount of from 0.2 to 20 parts by weight relative to 100 parts by weight of polymerizable monomers.

As these dispersants, those commercially available may be used as they are. In order to obtain dispersion particles having fine and uniform particle size, particles of the inorganic dispersant may be formed in a dispersion medium with high-speed stirring. For example, in the case of tricalcium phosphate, an aqueous sodium phosphate solution and an aqueous calcium chloride solution may be mixed with high-speed stirring, whereby the dispersant preferable for the suspension polymerization can be obtained. In order to make these dispersants finer, 0.001 to 0.1% by weight of a surfactant may be used in combination. Specifically, commercially available nonionic, anionic or cationic surfactants may be used. For example, preferred are the use of sodium dodecylsulfate, sodium pentadecylsulfate, sodium octylsulfate, sodium oleate, sodium laurate, potassium stearate or calcium oleate.

Applicable black colorants used in the invention include carbon black, magnetic materials and ones tinted with black by the use of the following yellow/magenta/cyan colorants.

Applicable yellow colorants include compounds typically represented by condensed azo compounds, isoindolinone compounds, anthraquinone compounds, azo metal complexes methine compounds, and arylanide compounds. More specifically, preferable ones include C.I. pigments yellow 12, 13, 14, 15, 17, 62, 74, 83, 93, 94, 95, 97, 109, 110, 111, 120, 127, 128, 129, 147, 168, 174, 176, 180, 181 and 191.

Applicable magenta colorants include condensed azo compounds, diketopyrolopirol compounds anthraquinone, quinacridone compounds, basic dye lake compounds, naphthol compounds, benzimidazolone compounds, thioindigo compounds, and perykebe compounds. More specifically, preferable ones include C.I. pigments red 2, 3, 5, 6, 7, 23, 48:2, 48:4, 57:1, 81:1, 144, 146, 166, 169, 177, 184, 185, 202, 206, 220, 221 and 254.

Applicable cyan colorants include copper phthalocyanine compounds and derivatives thereof, anthraquinone compounds, and basic dye lake compounds. More specifically, preferable ones include C.I. pigments blue 1, 7, 15, 15:1, 15:2, 15:3, 15:4, 60, 62 and 66.

These colorants may be used alone or in mixture, or in a solid-solution state. The colorants of the invention are selected in view of hue angle, chromaticity, brightness, weather resistance, OHP transparency, and dispersibility into toner. The amount of added colorants should be of from 1 to 20 parts by weight relative to 100 parts by weight of resins.

Applicable external additives used in the invention include, in addition to alumina, titanium oxide, silica, zirconium oxide, magnesium oxide and other oxides, silicon carbide, silicon nitride, boron nitride, aluminum nitride, magnesium carbonate, and organic silicon compounds.

Of these additives, alumina, titanium oxide, zirconium oxide, magnesium oxide and silica-treated fine particles thereof are preferable as inorganic fine oxide particles A for stabilizing charging of the toner, not depending upon temperature and humidity. Alumina, titanium oxide and silica-surface-treated fine particles thereof are preferable for improving fluidity of the toner.

No particular restriction is imposed on the preparing process thereof, an applicable process include a process of oxidizing a halide or alcoxide in a gas phase and a process of generating an additive while conducting hydrolysis in the presence of water. Baking should preferably be carried out at a low temperature at which primary particles do not aggregate.

In the invention, amorphous titanium oxide baked at a low temperature, anatase type titanium oxide, rutile type titanium oxide, amorphous alumina and γ-type alumina are particularly preferable because of the spherical shape and easy monodispersion into primary particles.

With a view to reducing environmental dependency of the toner charge amount upon temperature or humidity, and preventing separation from the toner surfaces, the foregoing inorganic oxide fine particles A should preferably be hydrophobicity-treated. Applicable hydrophobicity-treating agents include, for example, coupling agents such as silane coupling agents, titanium coupling agents and aluminum coupling agents, and oils such as silicone oil, fluorine-based oils, and various modified oils.

Of the above hydrophobicity-treating agent, the coupling agents are particularly preferred in view of achievement of a uniform treatment through reaction with residual groups on the inorganic oxide fine particles or adsorbed water, stabilization of toner charging and imparting of fluidity to toner.

Thus, the inorganic oxide fine particles A used in the present invention may particularly preferably be alumina or titanium oxide fine particles surface-treated while hydrolyzing a silane coupling agent, which are very effective in view of the stabilization of toner charging and the imparting of fluidity to toner.

The above hydrophobicity-treated inorganic oxide fine particles A may preferable have a hydrophobicity of from 20 to 80%, or more preferably from 40 to 80%.

If the inorganic oxide fine particles have a hydrophobicity smaller than 20%, the charge quantity may greatly decrease when the toner is left standing for a long period of time in an environment of high humidity, so that a mechanism for charge acceleration becomes necessary on the side of hardware, resulting in a complicated apparatus. If the inorganic oxide fine particles A have a hydrophobicity greater than 80%, it may be difficult to control the charging of the inorganic oxide fine particles themselves, tending to result in charge-up of the toner in an environment of low humidity.

The inorganic oxide fine particles A used in the invention should preferably have a BET specific surface area of from 60 to 230 $m^2/g$, or more preferably, from 70 to 180 $m^2/g$. A BET specific surface area of from 60 to 230 $m^2/g$ gives satisfactory chargeability and fluidity of toner and permits achievement of formation of a high-quality and high-density. A BET specific surface area of under 60 $m^2/g$ leads to a lower chargeability of toner and an image inferior in fine line reproducibility. A BET specific surface area of over 230 $m^2/g$ results, particularly when leaving under a high humidity, in an unstable chargeability of toner and easier occurrence of problems such as toner splash.

The inorganic oxide fine particles A are present in the form of primary particles or secondary particles on the toner particle surfaces. The inorganic oxide fine particles A on the toner particle surfaces should preferably have an average particle diameter of from 10 to 400 mμm, or more preferably, from 15 to 200 mμm, or further more preferably, from 15 to 100 mμm for the purpose of imparting fluidity to toner and preventing separation from the toner surfaces during use for a long period of time.

When the inorganic oxide fine particles A have an average particle diameter of under 10 mμm, even if the particles are combined with non-spherical particles described later, the particles tend to be easily buried in the toner particles surfaces, leading to deterioration of toner, and hence to a decrease in stability of toner concentration control.

An average particle diameter of the inorganic oxide fine particles A of over 400 mμm makes it difficult to obtain a sufficient fluidity to toner, and leads to non-uniform charging of toner, thus resulting in toner splash or fog.

In the inorganic oxide fine particles A, the ratio of the longer diameter to the shorter diameter should preferably be up to 1.5, or more preferably, up to 1.3. A ratio of the longer diameter to the shorter diameter of up to 1.5 leads to uniform dispersion onto the toner particle surfaces and permits maintenance of a satisfactory fluidity of toner for a long period of time. When the ratio of the longer diameter to the shorter diameter is larger than 1.5, dispersion onto the toner particle surfaces tends to be non-uniform, and particularly when left under a high humidity, easy separation from the toner particle surfaces may occur, thus resulting in problems such as toner splash.

The inorganic oxide fine particles A should preferably have a shape factor SF-1 of from 100 to 130, or more preferably, from 100 to 125, for the purpose of imparting fluidity to toner. An SF-1 of the inorganic oxide fine particles A of over 130 tends to cause non-uniform dispersion onto the toner particle surfaces and occurrence of problems.

The above hydrophobicity-treated inorganic oxide fine particles A should preferably have a light transmittance of 40% or more at a light wavelength of 400 mμm.

Namely, the inorganic oxide fine particles have a small primary particle diameter, but, when actually incorporated into the toner, they are not necessarily dispersed in the form of primary particles, and may sometimes be present in the form of secondary particles. Hence, whatever the primary particle diameter is small, the present invention may become less effective if the particles behaving as secondary particles has a large effective diameter. Nevertheless, those having a higher light transmittance at 400 mμm which is the minimum wavelength in the visible region have a correspondingly smaller secondary particle diameter. Thus, good effects can be expected for the fluidity-imparting performance and the sharpness of projected images in OHP. The reason why 400 mμm is selected is that it is a wavelength at a boundary region between ultraviolet and visible, and also it is said that light passes through particles with a diameter not larger than ½ of light wavelength. In view of these, any transmittance at wavelengths over 400 mμm becomes the highest as a matter of course and is not so meaningful. By hydrolyzing and surface-treating the coupling agent while dispersing mechanically the inorganic oxide fine particles so as to form primary particles in the presence of water, combination between particles becomes hard to occur and the treatment causes charge repulsing effect between particles, so that the inorganic oxide fine particles are surface-treated substantially in the state of primary particles, and there are available inorganic oxide fine particles having a light transmittance of at least 40% at a wavelength of 400 nm.

When the inorganic oxide fine particles are surface-treated while hydrolyzing the coupling agent in the pressure of water, a mechanical force is applied to disperse the fine particles into the primary particles. It is not therefore necessary to use a coupling agent generating a gas such as a chlorosilane or a silazane. Further, it is possible to use a high-vascosity coupling agent or silicone oil so far inapplicable because of the risk of combination of the particles, thus exhibiting a very remarkable effect of hydrophobicity treatment.

Any coupling agent such as a silane coupling agent or a titanium coupling agent may be used as the above coupling agent. Particularly preferable is the silane coupling agent as expressed by the following general formula:

RmSiYn

Where, R: alkoxy group, m: an integer of from 1 to 3,

Y: a hydrocarbon group including alkyl group, vinylgroup, glycidoxy group or methacryl group, and N: an integer of from 1 to 3.

Applicable silane coupling agents include, fQr example, vinyltrimethoxysilane, vinyltriethoxysilane, r-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecylmethoxysilane.

Or more preferably:

$$CaH_{2a+1}—Si(OC_bH_{2b+1})_3$$

Where a=4 to 12, and b=1 to 3.

When, in the above formula, a is smaller than 4, although the treatment becomes easier, a sufficient hydrophobicity cannot be achieved. If a is larger than 12, while there is available a sufficient hydrophobicity, combination of particles becomes more serious, thus leading to a poorer ability to impart fluidity. A value of b larger than 3 results in a decrease in reactivity and hence in insufficient hydrophobicity treatment. In the above general formula, therefore, the value of a should be of from 4 to 12, or more preferably, from 4 to 8, and b from 1 to 3, or more preferably, from 1 to 2.

The amount of treatment should be of from 1 to 50 parts by weight relative to 100 parts by weight, and preferably for uniform treatment without causing combination of particles, from 3 to 40 parts by weight, and the degree of hydrophobicity treatment should be of from 20 to 98%, or more preferably, from 30 to 90%, or further more preferably, from 40 to 80%.

As the non-spherical inorganic oxide fine particles B generated by combining a plurality of particles, known ones may be used. For the improvement of charging stability, developability, fluidity and storage property, the material should preferably be selected from silica, alumina, titanium oxide and double oxides thereof. Among others, silica is particularly preferable in that, depending upon the starting material, temperature and other oxidizing conditions, it is possible to control combination of primary particles arbitrarily to some extent. For example, silica generated through vapor phase oxidation of a silicon halide or alkoxide, known as the dry process, and silica prepared from dry silica called fumed silica, alkoxide and water glass, known as wet silica may be used. Dry silica is preferable because the surface and fine silica powder contain fewer silanol groups and there remains a smaller amount of residual $Na_2O$, $SO_3^{2-}$ and the like. In dry silica, it is possible to obtain a composite fine powder of silica and metal oxides by using silicon halide simultaneously with halides of other metals such as aluminum chloride and titanium chloride, and the resultant silica contains these other metals.

The non-spherical inorganic oxide fine particles B should preferably have a BET specific surface area of from 20 to 90 $m^2/g$, or more preferably, from 25 to 80 $m^2/g$. A BET specific surface area of from 20 to 90 $m^2/g$ ensures easy dispersion uniformly over toner particle surfaces, and serves as a spacer between the latent image bearing member and the toner particles during development, thereby permitting achievement of an improved transfer property. With a BET specific surface area of under 20 $m^2/g$, the particles tend to be separated from the toner particles on the latent image bearing member. A BET specific surface area of over 90 $m^2/g$ results in a poorer function as a spacer on the latent image bearing member, and tends to cause a decrease in transfer property particularly in a low humidity.

Figure 6:
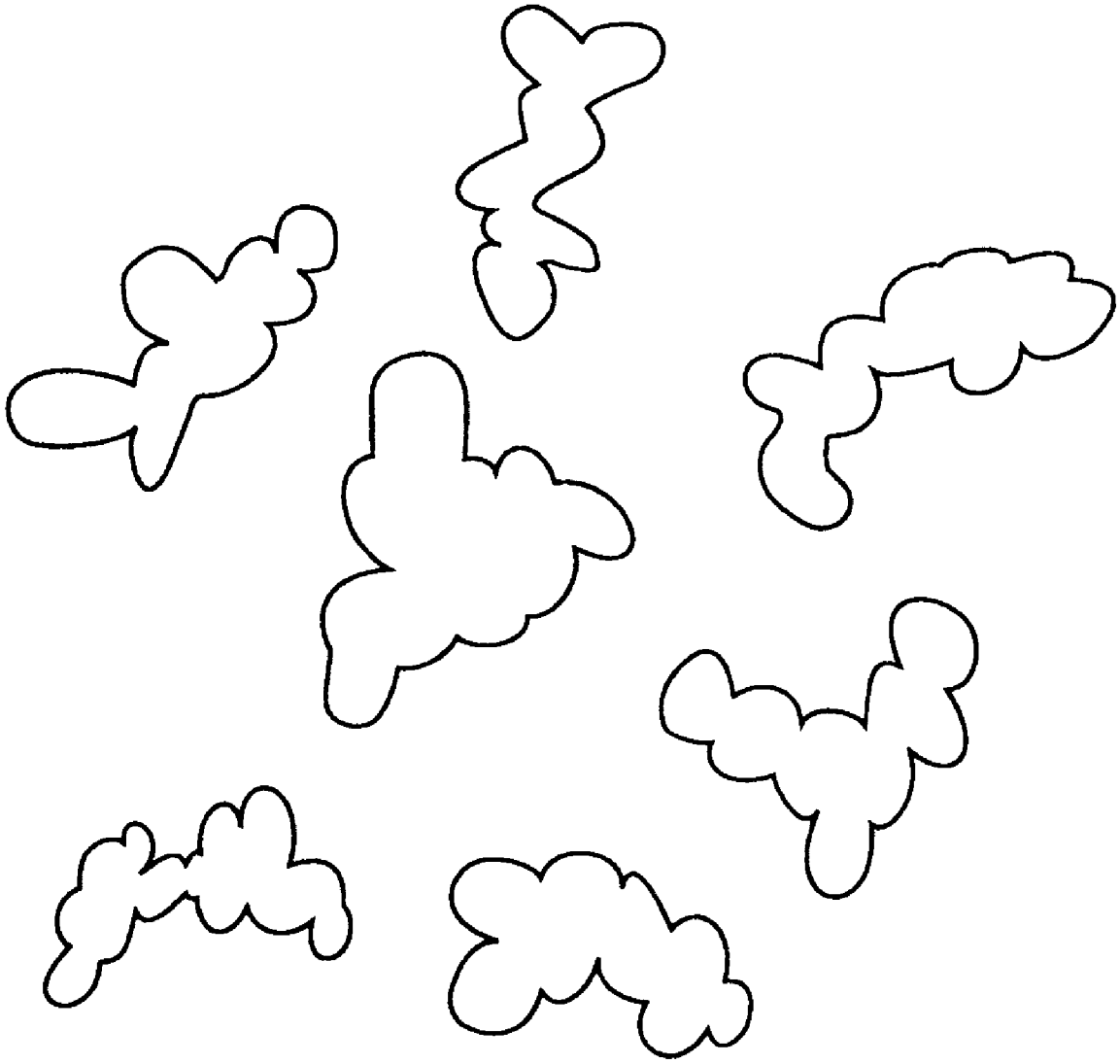
FIG. 6 is a schematic view illustrating the particle shape of non-spherical inorganic oxide fine particles.

Further the non-spherical inorganic oxide fine particles B should preferably have a shape, not one formed through simple combination of particles in a rod shape or in a lump, in which combined particles comprising a plurality of particles into a shape having a curved portion. This shape is preferable because it permits prevention of the inorganic oxide fine particles A from being incorporated into the toner surfaces, and inhibits the densest packing of the developer, and hence a change in bulk density of the developer. A schematic view of the particle shape of the non-spherical inorganic oxide fine particles B is shown in FIG. 6.

The term non-spherical as used herein means that the shape factor SF-1 is larger than 150, and SF-1 should preferably be at least 190, or more preferably, at least 200. When the inorganic oxide fine particles B have an SF-1 larger than 150, the degree of amorphism is high and the movement on the toner particles is slight, thus permitting maintenance of the function as a spacer. When the inorganic oxide fine particles B have an SF-1 of 150 or below, the bulk density of the developer tends to be smaller when printing continuously patterns of a small image ratio, leading to a lower toner concentration and a decrease in the image density.

The non-spherical inorganic oxide fine particles B should preferably have an average particle diameter larger than that of the inorganic oxide fine particles A, more preferably 20 mμm or more, larger than inorganic oxide fine particles A, further more preferably, 40 mμm or more larger than inorganic oxide fine particles A, for inhibiting burying into the toner particle surfaces. The average particle diameter of the non-spherical inorganic oxide fine particles B should preferably be of from 120 to 600 mμm, or more preferably, from 130 to 500 mμm. When the non-spherical inorganic oxide fine particles B have an average particle diameter of from 120 to 600 mμm, there is achieved a sufficient effect as a spacer for inhibiting incorporation of the inorganic oxide fine particles A into the toner particle surfaces. With an average particle diameter of the non-spherical inorganic oxide fine particles B of under 120 mμm, the resultant limited spacer effect as described above results in a large change in bulk density of the developer, thus tending to lead to a large change in toner concentration. When the non-spherical inorganic oxide fine particles B have an average particle diameter larger than 600 mμm, although a spacer effect is expected, the particles are easily separated from the toner particle surfaces, thus tending to cause grinding of, and damage to, the latent image bearing member.

Further, the non-spherical inorganic oxide fine particles B should preferably have a ratio of longer diameter to shorter diameter of at least 1.7, or more preferably, at least 2.0, or further more preferably, at least 3.0. With a ratio of longer to shorter diameters of 1.7 or above, incorporation into the toner particle surfaces is more difficult, so that the above spacer effect is displayed for a longer period of time. A ratio of longer to shorter diameters less than 1.7 tends to cause a decrease in the function of spacer upon printing a pattern having a small image ratio.

Such non-spherical inorganic oxide fine particles should preferably be prepared by the following process. In the case of a silica fine powder, for example, a non-spherical silica fine powder is produced by generating a silica fine powder through vapor phase oxidation of a silicon halide, and subjecting the resultant silica fine powder to a hydrophobicity treatment. Particularly upon vapor phase oxidation, it is desirable to perform baking at a high temperature which is sufficient to cause combination of silica primary particles.

It is particularly desirable to use relatively coarse combined particles selected from among the non-spherical inorganic oxide fine particles formed through combination of primary particles thus obtained, of which the particle size distribution has been adjusted so as to satisfy average particle diameter requirements in a present state on toner particles.

The non-magnetic toner should preferably contain the inorganic oxide fine particles A in an amount of from 0.1 to 2 parts by weight for stabilizing charging of the toner relative to 100 parts by weight of the non-magnetic toner, or more preferably, from 0.2 to 2 parts by weight for imparting fluidity, or further more preferably, from 0.2 to 1.5 parts by weight for improving fixability. The magnetic toner should preferably contain the non-spherical inorganic oxide fine particles B in an amount of from 0.3 to 3 parts by weight relative to 100 parts by weight of the non-magnetic toner for stabilizing bulk density of the developer, or more preferably, from 0.3 to 2.5 parts by weight for preventing grinding of the latent image bearing member, or further more preferably, from 0.3 to 2 parts by weight for ensuring holding stability in a high humidity, or still further more preferably, from 0.3 to 1.5 parts by weight for achieving OHP transparency.

In the invention, at least 5 inorganic oxide fine particles A should preferably be present per area of 0.5 μm×0.5 μm on the toner particle surfaces, or more preferably, at least 7, or further more preferably, at least 10.

From 1 to 30 non-spherical inorganic oxide particles B should preferably be present per area of 1.0 μm×1.0 μm on the toner particle surfaces, or more preferably, from 1 to 25, or further more preferably, from 5 to 25. When these present at least 5 inorganic oxide fine particles A per area of 0.5 μm×0.5 μm on the toner particle surface, an appropriate fluidity of toner is maintained and a high-quality and high-image-density image is available. Presence of only under 5 such particles leads to an insufficient fluidity of toner, and to easy decrease in the concentration of the resultant image. When from 1 to 30 non-spherical inorganic oxide fine particles B per area of 1.0 μm×1.0 μm on the toner particle surfaces, change in bulk density of the developer is minimized, and a stable image density is available. Pressure of more than 30 particles leads to easy separation of the non-spherical inorganic oxide fine particles B from the toner particle surfaces, and grinding of, or damage to, the latent image bearing member.

Applicable methods for discriminating the inorganic oxide fine particles A from the non-spherical inorganic oxide fine particles B on the toner particle surfaces include a method of determining from the difference in shape in an enlarged photograph of the toner particle surfaces taken on an electronic microscope, and a method of determining, using an X-ray microanalyzer, by detecting specific elements.

In the invention, fluidity of the developer can be maintained for along period of time, and a change in bulk density of the developer can be inhibited by externally adding the inorganic oxide fine particles A present in the form of primary particles or secondary particles, and the non-spherical inorganic oxide fine particles B generated through combination of a plurality of particles to the toner particles.

More specifically, the inorganic oxide fine particles A imparts fluidity to the toner, and the non-spherical inorganic oxide fine particles B serves as a spacer between toner particles or between toner particles and the carrier. Incorporation of the inorganic oxide fine particles A into the toner particle surfaces is thus prevented, and a change in bulk density of the developer is inhibited.

As a result, it is possible to maintain an appropriate toner concentration in the developer for a period of time by using the toner concentration detecting senser detecting a change in magnetic permeability of the developer by the use of inductance of a coil and the developer containing the inorganic oxide fine particles A and the non-spherical inorganic oxide fine particles B.

It is also a preferable embodiment to add further inorganic or organic substantially spherical particles having a primary particle diameter of at least 50 mμm (preferably with a specific surface area of under 50 $m^2/g$) for improving transferability and/or cleanability. For example, preferable particles include spherical silica particles, spherical polymethylsilsesquioxane particles, and spherical resin particles.

Other additive may be added in a slight amount within a range not exerting a substantial adverse effect to the toner of the invention. Applicable additives include, for example, lubricant powders such as Teflon powder, zinc stearate powder, and vinylidene polyfluoride powder; polishing agents such as celium oxide powder, silicon carbide powder, and strontium titanate powder; caking inhibitors such as titanium oxide powder, and aluminum oxide powder; conductivity imparting agents such as carbon black powder, zinc oxide powder, and tin oxide powder; and developability improving agents such as reverse-polarity organic and inorganic fine particles.

The carrier used in the present invention is a spherical magnetic powder dispersion type carrier prepared by dispersing a magnetic powder in a binder resin, which permits achievement of the apparent density or degree of compression of the developer described later. Detailed description will follow.

The carrier should have a weight average particle diameter of from 15 to 60 μm, or more preferably, from 20 to 60 μm, or further more preferably, from 20 to 45 μm, containing carrier particles having a particle diameter smaller than 22 μm in an amount of up to 20% by weight, or more preferably of from 0.05 to 15% by weight, or further more preferably, from 0.1 to 12% by weight, and carrier particles smaller than 16 μm in an amount of up to 3% by weight, or more preferably, up to 2% by weight, or further more preferably, up to 1% by weight.

A weight average particle diameter of the carrier larger than 60 μm tends to cause a decrease in uniformity of a solid image and a decrease in reproducibility of fine dots. A weight average particle diameter of the carrier of under 15 μm leads to easy adhesion of the carrier to the photosensitive member, occurrence of flaws on the photosensitive member, and causes deterioration of the image.

The amount of coarse powder of carrier having a particle diameter of 60 μm or more, which correlates with sharpness of the image, should preferably be of from 0.2 to 10% by weight. Outside the above range of particle size distribution, bulk density becomes larger, and it is difficult to achieve an appropriate degree of compression. A larger amount of fine powder results in adherence to the carrier, and an increase in the amount of coarse powder leads to easy occurrence of a lower image density.

The carrier used in the invention should preferably have a shape factor SF-1 of from 100 to 140, and a shape factor SF-2 of from 100 to 120.

With a shape factor SF-1 of over 140, the carrier comes off the spherical shape, and with an SF-2 of over 120, the surface irregularities of the carrier become more apparent. As in the above-mentioned case of toner particles, when the carrier particles have a non-spherical shape or surface irregularities, the surfaces are ground off by friction through contact between carrier particles or between carrier and toner particles during stirring, thereby bringing the particle shape closer to a sphere, resulting in a larger change in shape. When the carrier has a shape factor SF-1 of over 140 or an SF-2 of over 120, there occurs a large change in shape, and hence a large change in bulk density, thereby tending to cause the toner concentration detecting sensor using coil inductance to give an inappropriate output.

The carrier used in the invention has a volume resistivity volume of from $10^9$ to $10^{15}$ Ωcm, or more preferably, from $10^{13}$ to $10^{15}$ Ωcm.

When the carrier has a volume resistivity value of under $10^9$ Ωcm, with a low resistivity the development bias is injected in the developing zone, thus disturbing the latent image. When the volume resistivity of the carrier is over $10^{15}$ Ωcm, the carrier itself is charged up, tending to cause a decrease in the ability to impart charge to the supplied toner.

The carrier used in the invention is a magnetic powder dispersion type resin carrier formed by dispersing magnetic powders such as iron powder, ferrite powder and iron oxide powder. A magnetic powder dispersion type polymerization-process resin carrier manufactured by the polymerization is more preferable because of a smaller change in degree of compression, or a polymerization-process resin carrier containing magnetic powder and non-magnetic metal oxides is particularly preferable because of the possibility to arbitrarily control magnetic properties.

Preferable non-magnetic metal oxides include $Fe_2O_3$, $Al_2O_3$, $SiO_2$, CaO, SrO, MnO and mixtures thereof.

The magentic powder should preferably be lipophilic-treated as required. To improve hydrophobicity, the lipophilic treatment may be applied after surface treatment with silica, alumina or titania.

Similarly, the non-magnetic metal oxide should preferably be lipophilic-treated as well.

Applicable resins for dispersing the magnetic powder include, for example, styrene-(meth)acryl copolymer, polyester resins, epoxy resins, styrene-butadiene copolymer, acid resins, and melamine resins.

Among others, a phenol resin should preferably be contained. Containing the phenol resin permits achievement of excellent heat resistance and solvent resistance and ensures satisfactory coating upon resin-coating of the surface.

The carrier used in the invention should preferably be a carrier prepared by the polymerization for achieving uniform transferability.

The carrier particles of the invention should preferably comprise magnetic fine particles bound to hardened phenol as a matrix. The method for preparing the carrier will now be described.

Phenol and aldehyde materials are caused to react in an aqueous medium in the pressure of a basic catalyst, in coexistence with a magnetic powder and a suspension stabilizer.

Applicable phenol materials include alkylphenols such as phenol, m-cresol, p-test-butylphenol, o-propylphenol, resorcinol, and bisphenol A, and compounds having a phenolic hydroxyl group such as phenol halide in which part or all of benzene nucleus or alkyl group is substituted by chlorine or bromine atoms. Among others, phenol is the most suitable. Use of a compound other than phenol as phenol may make it difficult to generate particles, or even if particles are generated, they may be amorphous. In consideration of the shape property, phenol is the best. Applicable aldehydes include formaldehyde in the form of either formalin or paraformaldehyde and furfural. Formaldehyde is particularly preferable.

The molar ratio of aldehyde to phenol should preferably be of from 1 to 2, or more preferably, from 1.1 to 1.6.

A basic catalyst usually used for the manufacture of resor resin is employed as a basic catalyst in the invention. Applicable basic catalysts include, for example, ammonia water, hexamethylenetetramine and alkylamine such as dimethylamine, diethyltriamine and polyethyleneimine. The molar ratio of basic catalyst to phenol should preferably be of from 0.02 to 0.3.

When causing the aforesaid phenol and aldehyde in the presence of the basic catalyst, a magnetic powder as described above should be in coexistence. The amount of the magnetic powder should preferably be from 0.5 to 200 times as large as that of phenol in weight. In view of the saturation magnetic value and the particle strength of the carrier particles, this range should more preferably be from 4 to 100 times.

The particle diameter of the magnetic powder should preferably be of from 0.01 to 10 $\mu$m, or in view of the dispersion of fine particles in the aqueous medium and the strength of the generated carrier particles, from 0.05 to 5 $\mu$m.

Applicable suspension stabilizer include, for example, hydrophilic organic compounds such as carboxymethyl cellulose and polyvinyl alcohol, fluorine compounds such as calcium fluoride, and inorganic salts substantially insoluble in water such as calcium sulfate.

The amount of added suspension stabilizer should preferably be of from 0.2 to 10% by weight relative to the amount of phenol, or more preferably, from 0.5 to 3.5% by weight.

The reaction in the preparation process is accomplished in an aqueous medium. The amount of supplied water in this case should preferably be such that, for example, the solid concentration of the carrier is of from 30 to 95% by weight, or more preferably, from 60 to 90% by weight.

The reaction should preferably take place while stirring and slowly heating at a heating rate of from 0.5 to 1.5° C./min, or more preferably, from 0.8 to 1.2° C./min, at a reaction temperature of from 70 to 90° C., or more preferably, from 83 to 87° C. for a period of from 60 to 150 minutes, or more preferably, from 80 to 110 minutes. In this reaction, a hardening reaction proceeds simultaneously with this, thereby forming a hardened phenol matrix.

After the completion of the reaction and hardening as described above, the reaction product is cooled to a temperature of up to 40° C. There is thus available an aqueous dispersed solution of spherical particles in which the magnetic fine particles are uniformly dispersed in the hardened phenol resin matrix.

Then, by separating solids from the liquidus phase in accordance with a known process such as filtation or centrifugal separation of the aqueous dispersed solution and them washing and drying, there is available carrier particles comprising magnetic powder particles dispersed in the phenol resin matrix.

The method of the invention may be carried out either in a continuous manner or in a batch manner. The batch method is usually adopted.

Further, carrier particles having surfaces coated with a resin are used appropriately as core particles of the resin carrier comprising the magnetic powder particles dispersed as described above. The resin coating the core particle surfaces should preferably be a specific silicone resin, a flouroresin and a copolymer or a mixture of an arylic resin and a fluororesin. By covering the resin particles in which magnetic powder particles are dispersed further with a resin, the phenomenon known as toner spent, in which the toner adheres to the carrier surfaces, is inhibited, and the change control is facilitated.

As methods for forming the resin coat layer on the core material particle surface, any of the following may be used: a method in which a resin composition is dissolved in a suitable solvent and core particle are immersed in the resultant solution, followed by dissolution drying and high-temperature baking; a method in which carrier core particle are suspended in a fluidized system and a solution prepared by dissolved the above resin composition is spray-coated, followed by drying and high-temperature baking; and a method in which core particle are mixed with a powder or aqueous emulsion of the resin composition.

A method preferably used in the present invention is a method making use of a mixed solvent prepared by incorporating 0.1 to 5 parts by weight, and preferably 0.3 to 3 parts by weight, of water in 100 parts by weight of a solvent containing at least 5% by weight, and preferably at least 20% by weight, of a polar solvent such as a ketone or an alcohol. This method is preferred because the reactive silicone resin can be firmly made to adhere to the core particles. If the water is less than 0.1 parts by weight, the hydrolysis reaction of the reactive silicone resin can not be well taken place, hereby making it difficult to achieve thin-layer and uniform coating on the core particles. If it is more than 5 parts by weight, the reaction is difficult to control, resulting in a lowering of coat strength.

The carrier used in the invention should preferably have a $\sigma_{1000}$ within a range of from 20 to 45 $Am^2/g$ for an impressed magnetic field of 1,000 oersted, and more preferably, from 25 to 42 $Am^2/g$. The coercive force should preferably be of from 5 to 300 oersted, more preferably, from 10 to 200 oersted.

With a value of $\sigma_{1000}$ of from 20 to 40 $Am^2/g$, the bulk density of the developer shows only a limited change, so that this range is suitable for the application of the toner concentration detecting method of the invention. A value of $\sigma_{1000}$ of under 20 $Am^2/g$ leads to easier deposition of the carrier to the latent image bearing member in the developing zone, and easier occurrence of grinding of, and damage to the latent image bearing member. With a value of $\sigma_{1000}$ of over 45 $Am^2/g$, compression of the developer increases in the developing unit, thus resulting in accelerated deterioration of the developer and easier occurrence of fog.

A coercive force of from 5 to 300 oersted is suitable because the change in bulk density is small even when the developer is left under a high humidity for a long period of time. A coercive force of under 5 oersted leads to a large change in bulk density under a high or low humidity. A coercive force of over 300 oersted leads, on the other hand, to a lower miscibility of replenished toner, and this results in easy occurrence of fog.

In the present invention, in the case where the carrier is blended with the toner to prepare the two component type developer, good results are usually obtained when they are blended in such a proportion that the toner in the two component type developer is in a concentration of from 1 to 5% by weight, preferably from 3 to 12% by weight, and more preferably from 5 to 10% by weight. If the toner concentration is less than 1% by weight, the image density tends to lower. If the toner concentration is more than 15% by weight, fog and in-machine splash may increase to shorten the running lifetime of the two component type developer.

In the invention, prior to preparing a developer by mixing the carrier and the toner, it is desirable to add at least one kind of external additive to all or part of the magnetic powder dispersion type carrier. By previously adding external additives, change in ability to impart charge to the toner is minimized, and as a result, even when the developer is left for a long period of time, the charge in bulk density of the developer and the change in charge amount are slight, thus permitting achievement of very stable control of the toner concentration.

In the present invention, any of the foregoing inorganic oxide fine particles A and inorganic oxide fine particles B may be used as the inorganic oxide fine particles to be added previously to the carrier. In order to cause the particles to remain on the carrier for a long period of time and reduce a change in bulk density, the particles should preferably be non-spherical inorganic oxide fine particles B. To keep the particles adhering, to the carrier electrostatically to some extent, a preferred material is an inorganic oxide such as silica, or more preferably, silica having hydrophobicity-treated surfaces. The amount of addition should preferably be of from 0.001 to 0.2 parts by weight relative to 100 parts by weight of resin.

Japanese Patent Laid-Open No. 04-124,677 discloses a developer prepared by previously depositing inorganic oxide particles to the carrier. This is however to alleviate a change in charge amount of a developer use in a method for controlling the toner concentration from an image density by monitoring the image density. The publication contains no description about means/effect of inhibiting a change in bulk density as in the present invention, and the intent is quite different from the latter.

In the present invention, the developer should preferably have a degree of compression of from 5 to 19%, and an apparent density of from 1.2 to 2.0 g/cm$^3$. When the developer has a degree of compression and an apparent density within the aforesaid ranges, deterioration of toner is inhibited even when the toner is made finer in size, and the change in bulk density caused by the incorporation of an external additive into the toner particle surfaces during the use for a long period of time is reduced.

An example of preferred embodiments of the latent image bearing member (photosensitive member) used in the present invention will be described below.

As the conductive substrate, a cylindrical member or a belt of a metal such as aluminum or stainless steel, aluminum alloy, an indium oxide-tin oxide ally, a plastic having a coat layer formed of any of these metals and alloys, a paper or plastic impregnated with conductive particles, and a plastic having a conductive ploymer is used.

On the conductive substrate, a subbing layer may be provided for the purpose of, e.g., improving adhesion of the photosensitive layer, improving coating properties, covering defects on the substrate, improving properties of charge injection from the substrate and protecting the photosensitive layer from electrical breakdown. The subbing layer may be formed of material such as polyvinyl alcohol, poly-N-vinyl imidazole, polyethylene oxide, ethyl cellulose, methyl cellulose, nitrocellulose, an ethylene-acrylate copolymer, polyvinyl butyral, phenol resin, casein, polyamide, copolymer nylon, glue, gelatin, polyurethane or aluminum oxide. The subbing layer may usually be in a thickness approximately of from 0.1 to 10 $\mu$m, and preferably from 0.1 to 3 $\mu$m.

The charge generation layer may be formed by applying a fluid prepared by dispersing and coating charge-generating material in a binder resin, or by vacuum deposition of the charge-generating material. The charge-generating material includes, for example, azo pigments, phtalocyanine pigments indigo pigments, perylene pigments, polycyclic quinone pigments, squarilium dyes, pyrylium salts, thiopyrylium salts, triphenylmethane dyes, and inorganic substances such as selenium and amorphous silicon. As the charge generating layer, it can be selected from a vast range of binder resins, including, e.g., polycarbonate resins, polyester resins, polyvinyl butyral resins, polysterene resins, acrylic resins, methacrylic resins, phenol resins, silicon resins, epoxy resins and vinyl acetate resins. The binder resin contained in the charge generation layer may be in an amount not more than 80% by weight, and preferably not more than 40% by weight. The charge generation layer may preferably have a thickness of 5 $\mu$m or smaller, and particularly from 0.05 to 2 $\mu$m.

The charge transport layer has the function to receive charge carriers from the charge generation layer in the presence of an electric field, and transport them. The charge transport layer is formed by applying a solution prepared by dissolving a charge-transporting material in a solvent optionally together with a binder resin, and usually may have a layer thickness of from 5 to 40 $\mu$m. The charge-transporting material may include polycyclic aromatic compounds having in its main chain or side chain a structure such as biphenylene, anthracene, pyrene or phenanthrene; nitrogen-containing cyclic compounds such as indole, carbazole, oxadiazole and pyrazoline; hydrozone compounds; styryl compounds; and inorganic compounds such as selenium, selenium-tellurium, amorphous silicon and cadmium sulfide.

The binder resin used to disperse the charge-transporting material therein may include a resins such as polycarbonate resins, polyester resins, polymethacrylates, polystyrene resins, acrylic resins and polyamide resins and organic photoconductive polymers such as poly-N-vinyl carbazole and polyvinyl anthracene.

The latent image bearing member used in the present invention has a charge injection layer as a layer most distant from the support i.e., as a surface layer. This charge injection layer may preferably have a volume resistivity of from $1\times10^8$ to $1\times10^{15}$ Ωcm in order to obtain a satisfactory charging performance and to barely cause smeared images. Especially in view of the smeared images, it may more preferably be from $1\times10^{10}$ to $1\times10^{15}$ Ωcm. Further taking account of environmental variations and so forth, it may most preferably be from $1\times10^{10}$ to $1\times10^{13}$ Ωcm. If it is lower than $1\times10^8$ Ωcm, the charges produced may not be retained in the surface direction in an environment of high humidity, tending to cause smeared images. If it is higher than $1\times10^{15}$ Ωcm, the charges injected from the charging member may not be well injected, tending to cause faulty charging. When such as functional layer is provided on the latent image bearing member surface, the layer has the function of retaining the charges injected from the charging member, and also has the function of allowing the charges to transfer to the latent image bearing member support material to make the residual potential lower when explosure. Further, the structure used the charging member and the latent image bearing member in the invention has enabled the charge start voltage Vth to be small and the charge potential of the latent image bearing member to converge on about 90% or more of the voltage applied to the charging member.

For example, when a DC voltage of from 100 to 2,000 V as an absolute value is applied to the charging member at a process speed of 1,000 mm/minute or below, the charge potential of the latent image bearing member having the charge injection layer of the present invention can be controlled to be 80% or more or further 90% or more of the applied voltage. On the other hand, the latent image bearing member charge potential attained by conventional discharging has been about 200 V which is only about 30%, when the applied voltage is a DC voltage of 700 V.

This charge injection layer is constituted of an inorganic layer such as a metal-deposited film, or a conductive fine particle-dispersed resin layer formed by dispersing conductive fine particles in a binder resin. The deposited film is formed by vacuum deposition, and the conductive fine particle-dispersed resin layer is formed by using a suitable coating process such as dip coating, spray coating, roll coating or beam coating. This layer may also be constituted by mixing or copolymerizing an insulating binder resin with a resin having light-transmission properties and a high ion conductivity, or may be constituted solely of a resin having a medium resistance and a photoconductivity. In the case of the conductive fine particle-dispersed resin film, the conductive fine particles may preferably be added in an amount of 2 to 190% by weight based on the weight of the binder resin. If the conductive fine particles are added in an amount less than 2% by weight, the desired volume resistivity may be difficult to attain. If it is more than 190% by weight, the film strength may lower and the charge injection layer is liable to be scraped off, tending to result in a short lifetime of the latent image bearing member.

The binder resin of the charge injection layer may include polyester, polycarbonate, acrylic resins, epoxy resins and phenol resins, as well as a curing agent for these resins, any of which may be used alone or in a combination of two or more. When the conductive fine particles are dispersed in a large quantity, it is preferred that the conductive fine particles are dispersed by the use of a reactive monomer or a reactive oligomer, and the latent image bearing member surface is coated with the resultant dispersion, followed by curing with light or heat. Further, when the photosensitive layer is formed of amorphous silicon, the charge injection layer may preferably be formed of SiC.

The conductive fine particles dispersed in the binder resin of the charge injection layer may include fine particles of metals or metal oxides. Preferably, they are ultrafine particles such as zinc oxide, titanium oxide, tin oxide, antimony oxide, indium oxide, bismuth oxide, tin oxide-coated titanium oxide, tin-coated indium oxide, antimony-coated tin oxide and zirconium oxide. Any of these may be used alone or in a combination of two or more. In general, when particles are dispersed in the charge injection layer, in order to prevent the incident light from being scattered by dispersed particles, it is necessary for the particles to have a diameter smaller than the wavelength of the incident light. The conductive and insulating fine particles dispersed in the surface in the present invention may preferably have particle diameters of 0.5 $\mu$m or smaller.

Further, in the present invention, the charge injection layer may preferably contain lubricant particles. The reason thereof is that the friction between the latent image bearing member and the charging member may be reduced at the time of charging and hence the charging nip can be expanded to bring about an improvement in charging performance. In particular, as the lubricant particles, it is preferable to use fluorine resins, silicone resins or polyolefin resins, having a low critical surface tension. More preferably, tetrafluoroethylene resin (PTFE) may be used. In this instance, the lubricant particles may be added in an amount of from 2 to 50% by weight, and preferably from 5 to 40% by weight, based on the weight of the resin. This is because, if they are of less than 2% by weight, the lubricant particles are not in a sufficient quantity and hence the charging performance may not be sufficiently improved, and if they are of more than 50% by weight, the resolution of image and the sensitivity of the photosensitive member may greatly lower.

The charge injection layer in the present invention may preferably have a layer thickness of from 0.1 to 10 $\mu$m, and particularly from 1 to 7 $\mu$m.

If it has a layer thickness smaller than 0.1 $\mu$m, the layer may lose its durability to fine scratches, and consequently faulty images due to faulty injection tend to occur. If it is larger than 10 $\mu$m, the injected charges may diffuse to tend to cause disorder of images.

In the present invention, fluorine-containing fine resin particles may be used in the latent image bearing member. The fluorine-containing fine resin particles are comprised of one or more materials selected from polytetrafluoroethylene, polychlorotrifluoroethylene, polyvinylidene fluoride, polydichlorodifluoroethylene, a tetrafluoroethylene-perfluoroalkyl vinyl ether copolymer, a tetrafluoroethylene-hexafluoropropylene copolymer, a tetrafluoroethylene-ethylene copolymer and a tetrafluoroethylene-hexafluoropropylene-perfluoroalkyl vinyl ether copolymer. Commercially available fluorine-containing fine resin particles may be used as they are. Those having a molecular weight of from 3,000 to 5,000,000 may be used, and these may preferably have a particle diameter of from 0.01 to 10 $\mu$m, and more preferably from 0.05 to 2.0 $\mu$m.

In many instances, the above fluorine-containing fine resin particles, charge-generating material and charge-transporting material are dispersed and incorporated respectively into binder resins having film forming properties to form each of protective layers and photosensitive layers. Such binder resins may include polyester, polyurethane, polyacrylate, polyethylene, polystyrene, polycarbonate, polyamide, polypropylene, polyidimide, phenol resins, acrylic resins, silicone resins, epoxy resins, urea resins, allyl resisns, alkyd resins, polyamide-imide, nylons, polysulfone, polyallyl ethers, polyacetals and butyral resins.

The conductive support of the latent image bearing member may be made of a metal such as iron, copper, gold, silver, aluminum, zinc, titanium, lead, nickel, tin, antimony or indium or an alloy thereof, an oxide of any of these metals, carbon, or a conductive polymer. It may have a drum shape such as a cylinder or a column, a belt, or a sheet. The above conductive materials may be molded as they are, may be used in the form of coating materials, may be vacuum-deposited, or may be processed by etching or plasma treatment.

Now, the image forming apparatus using a two-component type developer will be described.

In the image forming apparatus of the invention, a two-component type developer having a toner and a carrier is held by a developer bearing member, transferred to a developing zone, and a latent image held by a latent image bearing member is developed with the toner contained in the two-component type developer.

While corona charging or charging by means of pin electrodes is applicable for charging of the image forming apparatus of the invention, there is preferably used a method known as the contact charging conducting charging by bringing a charging roller, a charging blade, a conductive brush or a magnetic brush into contact with the latent image bearing member. Among others, the method of conducting charging by bringing a magnetic brush into contact with the surface of the latent image bearing member is appropriate because of the durability of the latent image bearing member. In this case, configuration of the charger comprising a magnet roll or a conductive sleeve having therein a magnet roll having a surface uniformly coated with charging magnetic particles as a charging magnetic particles holding member should preferably be employed.

Applicable materials for the charging magnetic particles used in the invention include hard ferrite materials such as strontium, barium and rare-earth metals, and ferrite materials such as magnetite, copper, zinc, nickel and manganese.

The above charging magnetic particles may preferably have a weight average particle diameter of from 5 to 45 $\mu$m, preferably from 10 to 45 $\mu$m, and more preferably from 20 to 40 $\mu$m.

If the charging magnetic particles have a weight average particle diameter smaller than 5 $\mu$m, the charging performance may be good but the magnetic binding force may lower, so that the charging magnetic particles liberated from the conductive magnetic brush charging assembly may be to the developing step in such a state that they are adhered to the surface of the latent image bearing member, resulting in inclusion of the charging magnetic particles into the developing assembly to cause a disorder of electrostatic latent images at the time of development in some cases. If the charging magnetic particles have a weight average particle diameter larger than 45 $\mu$m, the brush ears formed of the charging magnetic particles may become coarse to tend to cause uneven charging and image deterioration.

The charging member used in the present invention may have a volume resistivity of from $10^7$ to $10^{11}$ Ωcm, and preferably from $10^7$ to $10^9$ Ωcm.

If the charging member have a volume resistivity lower than $10^7$ Ωcm, it may be difficult to prevent the magnetic particles serving as a charging member from adhering to the latent image bearing member. If the charging member have a volume resistivity higher than $10^{11}$ Ωcm, their charge-imparting performance to the latent image bearing member may lower especially in an environment of low humidity to tend to cause faulty charging.

The charging magnetic particles may also preferably be provided with surface layers on the core surfaces. Materials for such surface layers may include resins (preferably fluorine resins and silicone resins) containing coupling agents such as silane coupling agents and titanium coupling agents, conductive resins or conductive particles.

Charging magnetic particles not coated with resin and charging magnetic particles coated with resin may be used in combination. In such as instance, they may be mixed in a proportion not more than 50% by weight based on the total weight of magnetic particles in the charging assembly. This is because, if they are more than 50% by weight, the charging magnetic particles treated with the coupling agent may be less effective.

The weight loss on heating may preferably be 0.5% by weight or less, and more preferably 0.2% by weight or less.

Here, the weight loss on heating corresponds to a loss in weight at temperatures of from 150° C. to 800° C. in an nitrogen atmosphere in analysis using a thermobalance.

The smallest gap between the charging magnetic particles holding member and the latent image bearing member should preferably be of from 0.3 to 2.0 mm. A gap smaller than 0.3 mm causes leak between the conductive portion of charging magnetic particle holding member and the latent image bearing member, and may damage the latent image bearing member.

The amount of the charging magnetic particles held by the charging magnetic particle holding member should preferably be of from 50 to 500 mg/cm$^2$, or more preferably, from 100 to 300 mg/cm$^2$, thereby obtaining a stable charging property.

When using injection charging, the charging bias applied to the charging member suffices to comprise only a DC component, but application of a slight AC component improves the image quality. The AC component should preferably have, depending upon the process speed of the apparatus, a frequency of from 100 Hz to 10 kHz, and a peak-to-peak voltage of the applied AC component of up to 1,000 V. With a voltage of over 1,000 V, a latent image bearing member potential occurs relative to the applied voltage, causing waves of potential on the latent image surface, and this may cause fog or a low density. When using the method based on discharge, the AC component should, depending upon the process speed of the apparatus, preferably have a frequency of from about 100 Hz to 10 kHz, and a peak-to peak voltage of the applied AC component of at least 1,000 V, and more than twice as high as the discharge start voltage. This is to obtain a sufficient unification effect for the magnetic brush and the latent image bearing member surface. The waveform of the applied AC component may be a sine wave, a rectangular wave or a saw tooth wave.

Charging magnetic particles in excess may be held and circulated within the charger. Known means such as a laser or an LED is employed for the exposure of the image.

The charging magnetic brush may be moved either in the same direction or in the reverse direction at the contact portion relative to the travelling direction of the latent image bearing member, but with a view to increasing the chance of contact between the latent image bearing member and the charging magnetic brush, it should preferably be moved in the reverse direction.

It is desirable to control charging of residual toner after transfer upon charging the latent image bearing member so that the residual toner after transfer on the latent image bearing member is collected by the developer bearing member also during the developing step. When the latent image bearing member is charged by contact charging, the residual toner adheres to the charger. Such toner is collected in the developing step by transporting it to the developing zone by the use of the surface of the latent image bearing member.

Collection and reuse of the residual toner after transfer adhering to the charger by transporting it to the developing zone by the utilization of the latent image bearing member surface can be accomplished even without changing the charging bias. It is however desirable to change it into a charging bias which would facilitate displacement of the toner from the charger to the latent image bearing member. Particularly when there occurs a jam during transfer or when continuously developing an image having a high image ratio, an excess amount of toner may adhere to the charger. In such a case, it is desirable to change the charging bias to displace the toner from the charger to the latent image bearing member by the use of the periods during which the image is no formed on the latent image bearing member during operation of the apparatus. Periods during which the image is not formed include the pre-rotation time, the past-rotation time and the interval between transfer sheets. A bias facilitating separation of the toner from the charger can be achieved by slightly reducing voltage between peaks of the AC component, or using the DC component. There is also applicable a method of reducing the AC implementation value by using the same peak-to-peak voltage and changing the waveform.

When collecting the residual toner in the developing step by controlling charging of the residual toner during the charging step, the latent image bearing member can be cleaned without using a cleaning member such as a. cleaning blade.

When the cleaning method of collecting the residual toner in the developing step is combined with contact charging, the external additives on the toner particle surfaces tend to be easily incorporated into the toner particles. From the point of view of inhibiting a change in bulk density of the toner, therefore, which is a severer condition, this can be achieved without any problem in the present invention.

The developing method will be now described below.

In the present invention, for example, of the developing sleeve (developer bearing member) and the magnet roller installed therein, the magnet roller is set stationaily and the developing sleeve alone is rotated, where the two component type developer comprised of the carrier comprising magnetic particles and the insulative color toner is circulated and transported onto the developing sleeve and an electrostatic latent image held on the surface of a latent image bearing member is developed using the two component type developer.

In the present invention, the electrostatic latent image may preferably be developed by the toner of the two component type developer under application of a developing bias in the developing zone.

A particularly preferred developing bias will be described below in detail.

Figure 2:
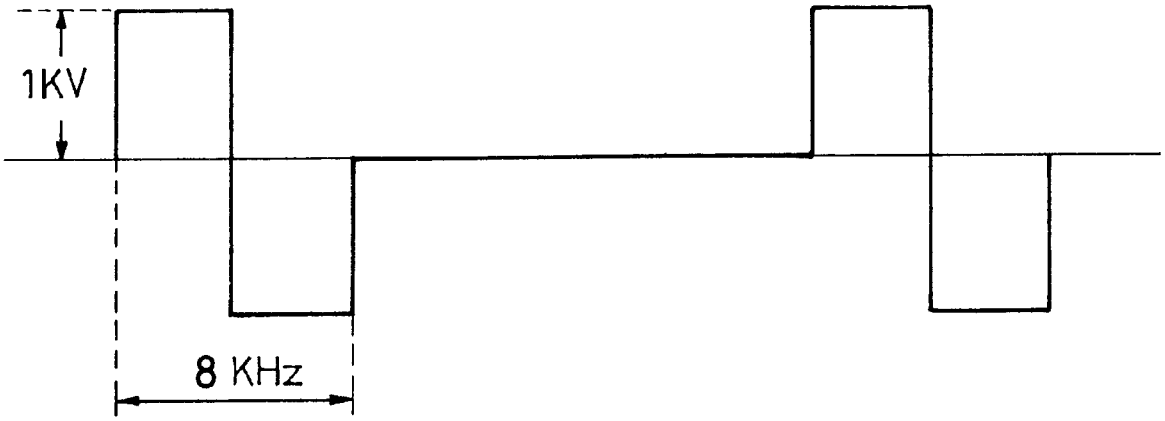
FIG. 2 illustrates an alternate electric field used in the Example 1.

In the present invention, in order to form a developing electric field in the developing zone defined between the latent image bearing member and the developer bearing member, it is preferred that a development voltage having a discontinuous AC component as shown in FIG. 2 is applied to the developer bearing member to develop the latent image held on the latent image bearing member, by the use of the toner of the two component type developer carried on the developer bearing member. This developing voltage comprises, more specifically, a first voltage directing the toner in the developing zone from the latent image bearing member to the developer bearing member, a second voltage directing the toner from the developer bearing member to the latent image bearing member, and a third voltage between the first voltage and the second voltage. The developing voltage as described above is applied to the developer bearing member to form a developing electric field between the latent image bearing member and the developer bearing member.

In addition, the time ($T_2$) for which the third voltage intermediate between the first voltage and the second voltage is applied to the developer carrying member, i.e., the time for which the AC voltage pauses, may be made longer than the total time ($T_1$) for which the first voltage for directing the toner from the latent image member toward the developer bearing member and the second voltage for directing the toner from the developer bearing member toward the latent image bearing member are applied to the developer carrying member, i.e., the time for which the AC component operates. This is particularly preferred because the toner can be rearranged on the latent image bearing member to reproduce images faithful to latent images.

Specifically, between the latent image bearing member and the developer bearing member in the developing zone, an electric field in which the toner is directed from the latent image bearing member toward the developer bearing member and an electric field in which the toner is directed from the developer bearing member toward the latent image bearing member may be formed at least once, and thereafter an electric field in which the toner is directed from the developer bearing member toward the latent image bearing member in an image area of the latent image bearing member and an electric field in which the toner is directed from the latent image bearing member toward the developer bearing member in a non-image area of the latent image bearing member may be formed for a given time, thereby developing a latent image held on the latent image bearing member by the use of the toner of the two component type developer carried on the developer bearing member, where the time ($T_2$) for forming the electric field in which the toner is directed from the developer bearing member toward the latent image bearing member in an image area of the latent image bearing member and the electric field in which the toner is directed from the latent image bearing member toward the developer bearing member in a non-image area of the latent image bearing member may preferably be made longer than the total time ($T_1$) for the forming the electric field in which the toner is directed from the latent image bearing member toward the developer bearing member and the electric field in which the toner is directed from the developer bearing member toward the latent image bearing member.

The carrier adhesion to the latent image bearing member may more hardly occur, when development is carried out in the presence of a developing electric field where alternation is periodically made off in the developing process in which development is carried out while forming the above specific developing electric field, i.e., an alternating electric field. The reason therefor is still unclear, and is presumed as follows:

In conventional continuous sinusoidal or rectangular waves, when an electric field intensity is made higher in an attempt to achieve a higher image density. The toner and the carrier reciprocate in combination between the latent image bearing member and the developer bearing member, and as a result, the carrier comes into a strong sliding contact with the latent image bearing member, thus producing carrier adhesion. This tendency is more apparent according as the carrier contains more fine particles.

However, the application of the specific developing electric field as in the present invention causes the toner or the carrier to incompletely reciprocate between the developer bearing member and the latent image bearing member under one pulse. Hence, after that, in the case when a potential difference VcOnt between the surface potential of the latent image bearing member and the potential of a direct current component of a developing bias, when $V_{cont}<0$, the $V_{cont}$ acts so as to allow the carrier to fly from the developer bearing member. However, the carrier adhesion can be prevented by controlling the magnetic properties of the carrier and the magnetic flux density at the developing zone of the magnet roller. When $V_{cont}>0$, the force of a magnetic field and the $V_{cont}$ ant to attract the carrier to the side of the developer bearing member, so that no carrier adhesion occurs.

Magnetic properties of carriers are influenced by a magnet roller installed in a developing sleeve, and greatly influence the developing performance and transport performance of developers.

In the present invention, on the developing sleeve incorporating the magnet roller, the developing sleeve alone is rotated while fixing the magnet roller, the carrier comprising the magnetic particles and the two-component type developer comprising an insulating color toner are circulated and carried on the developing sleeve, and an electrostatic image on the surface of the latent image bearing member is developed with the two-component type developer. A developed image excellent in uniformity of image and in gradation reproducibility is available in color copying by satisfying conditions (1) the magnet roller having a polar configuration having a repulsive pole; (2) a magnetic flux density in the developing zone of from 500 to 1,200 gauss; and (3) a saturation magnetization of the carrier of from 20 to 70 $Am^2/kg$.

With a saturation magnetization of over 70 $Am^2/kg$ (relative to an impressed magnetic field of 3,000 oersted), a brush-shaped spike comprising the carrier and the toner on the developing sleeve opposite to the latent image on the latent image bearing member during development is hard and dense, resulting in a lower reproducibility of gradation and intermediate toner. With a saturation magnetization of under 20 $Am^2/kg$, it becomes difficult to hold the toner and the carrier in a satisfactory condition on the developing sleeve, thus causing problems such as more serious carrier adhesion and toner splash.

In the present invention, the direction of rotation of the developing sleeve may be either in the same direction or in the reverse direction as the rotating direction of the latent image bearing member.

When collecting the residual toner after transfer in the developing step, however, rotation of the developing sleeve in the direction reverse to that of the latent image bearing member in the developing zone permits more satisfactory collection of the residual toner remaining on the latent image bearing member, as compared with rotation in the same direction. Occurrence of such problems as fog and image memory can therefore be inhibited.

Further, in the present invention, a developer regulating blade is arranged opposite to the developing sleeve for regulating the amount of the developer carried on the surface of the developing sleeve. The developer regulating blade should preferably be arranged below the developer bearing member. The developer regulating blade, if arranged above, does not permit achievement of uniform transport of the developer unless a compressing force sufficient to overcome the gravity of the developer is applied. As a result, there occurs an increase in frictional force between developer particles caused by the rotation of the developing sleeve. Deterioration of the external additives is accelerated more according as the developer sleeve rotates more, thus causing the change in fluidity to increase from the initial toner. A large variation of the toner fluidity means a large amount of change in bulk density between the developer particles. The change in bulk density is larger according as the external additives are smaller. Deterioration of the external additives causes a change in pores between developer particles, resulting in a change bulk density of the developer. In the present invention, in contrast, in which the developer regulating blade is arranged below the developing sleeve, it is not necessary to apply a compressing force to overcome the gravity. Even when reducing the amount of developer accumulating near the blade, uniform transport of the developer is ensured, resulting in inhibition of deterioration caused by compression of the developer, and permitting reduction of change in bulk density.

Then, the developed toner image is transferred onto a transfer medium such as paper.

Applicable transfer means include contact transfer means such as a transfer blade and a transfer roller which comes into contact with the latent image bearing member and is capable of directly impressing transfer bias, and non-contact transfer means which carries out transfer by applying transfer bias from a corona charger.

Because of the possibility to inhibit the amount of ozone produced upon applying transfer bias, it is preferable to adopt the contact transfer means.

The residual toner remaining on the latent image bearing member after transfer can be removed also by using a cleaning member such as a cleaning blade brought into contact with the latent image bearing member. It is possible to remove the residual toner also by adjusting charge of the residual toner upon charging and collecting the residual toner in the developing step.

FIG. 1 is a schematic view illustrating an embodiment of the image forming apparatus of the invention. The embodiment of the present invention will be described with reference to FIG. 1.

A magnetic brush comprising magnetic particles 23 is formed on the surface of a transport sleeve 22 by means of magnetic force of a magnet roller 21. A photosensitive drum 1 is charge by bringing this magnetic brush into contact with the surface of the photosensitive drum 1. Charging bias is impressed to the transport sleeve 22 by bias impressing means not shown. An electrostatic image is formed by a laser beam 24 irradiated by an exposure unit not shown to the charged photosensitive drum 1. The electrostatic image formed on the photosensitive drum 1 is developed by a toner 19*a* in a developer 19 carried by a developing sleeve 11, which contains a magnet roller 12, impressed with developing bias by a bias impressing unit not shown.

Now, the flow of the developer will be described below.

A developing vessel 4 is divided by partitions 17 into a developing chamber R1 and a stirring chamber R2, having developer transport screws 13 and 14, respectively. A toner storing chamber R3 containing replenishing toner 18 is provided above the stirring chamber R2, and a replenishing port 20 is provided below the storing chamber R3.

The developer is transported in a single direction along the longitudinal direction of the developing sleeve 11 while stirring the developer in the developing chamber R1 by rotating the developer transport screw 13. Openings not shown are provided one on the near side and the other on the far side of the drawing in the partition 17. The developer transported to one side of the developing chamber R1 by the screw 13 is sent through the opening in the partition 17 on that side into the stirring chamber R2, and passed to the developer transport screw 14. The screw 14 rotates in a direction reverse to that of the screw 13, and transports the developer in the stirring chamber R2, the developer passed from the developing chamber R1 and the toner replenished from the toner storing chamber R3, while stirring and mixing the same, in a direction reverse to that of the screw 13 to send the same through the other opening of the partition 17 into the developing chamber R1.

When developing the electrostatic image formed on the photosensitive drum 1, the developer 19 in the developing chamber R1 is first sucked up under the effect of the magnetic force of the magnet roller 12 and carried on the surface of the developing sleeve 11. The developer carried on the developing sleeve 11 is transported to a regulating blade 15 along with the rotation of the developing sleeve 11. After being regulated into a developer thin layer having an appropriate thickness, the developer reaches a developing zone formed between the developing sleeve 11 and the photosensitive drum 1 opposed to each other. A magnetic pole (developing pole) N1 is located on the portion of the magnet roller 12 corresponding to the developing zone, and the developing pole N1 forms a developing magnetic field in the developing zone. This developing magnetic field forms a head of developer, thus forming a magnetic brush of the developer in the developing zone. The magnetic brush comes into contact with the photosensitive drum 1, and as a result, the toner adhering to the magnetic brush and the toner adhering to the surface of the developing sleeve 11 displace and adhere to the region of the electrostatic latent image on the photosensitive drum 1, and the latent image is visualized in the form of a toner image.

Upon completion of development, the developer is brought back into the developing vessel 4 along with the rotation of the developing sleeve 11, peeled off from the developing sleeve 11 by a repulsive magnetic field between the magnetic poles S1 and S2, drops into the developing chamber R1 and the stirring chamber R2 for collection.

When the T/C ratio (the mixing ratio of toner to carrier, i.e., the toner concentration in the developer) of the developer 19 in the developing vessel 4 is reduced by the development as described above, the toner from the toner storing chamber R3 in an amount corresponding to that consumed by development is gravity-supplied to the stirring chamber R2 to keep a constant T/C of the developer 19. A toner concentration detecting sensor 28 detecting a change in magnetic permeability of a developer by the use of inductance of a coil is employed for the detection of T/C ratio of the developer 19 in the vessel 4. The toner concentration sensor 28 has therein a coil not shown.

A developer regulating blade 15 provided below the developing sleeve 11 to control the layer thickness of the developer 19 on the developing sleeve 11 is a non-magnetic blade made of a non-magnetic material such as aluminum or SUS316 stainless steel, and the distance between the end of the non-magnetic blade and the face of the developing sleeve 11 is 300 to 1,000 $\mu$m, and preferably 400 to 900 $\mu$m. If this distance is smaller than 300 $\mu$m, the magnetic carrier may be caught between them to tend to make the developing layer uneven, and also the developer necessary for carrying out good development may not be coated on the sleeve, bringing about such a problem that only developed image with a low density and much unevenness can be obtained. In order to prevent uneven coating (what is called the blade clog) due to unnecessary particles included in the developer, the distance may preferably be 400 $\mu$m or larger. If it is larger than 1,000 $\mu$m, the quantity of the developer applied on the developing sleeve 11 increases so that the developer layer thickness cannot be regulated, bringing about such problems that the magnetic carrier particles adhere to the photosensitive drum 1 in a large quantity and the rotation of the developer and the control of the developer by the regulating blade 15 may become less effective for development control to cause fog because of a shortage of triboelectricity of the toner.

When the developing sleeve 11 is rotated in the direction of an arrow, the magnetic carrier particles in this layer move slower as they are detached from the sleeve surface in accordance with the balance between the binding force based on magnetic force and gravity and the transport force acting toward the transport of the developing sleeve 11. Some particles of course, drop down due to gravity.

Accordingly, the position to arrange the magnetic poles N and the fluidity and magnetic properties of the magnetic carrier particles are appropriately selected, so that the magnetic carrier particle layer is transported toward the magnetic pole N1 as it stands nearer to the sleeve, to form a moving layer. Along this movement of the magnetic carrier particles, the developer is transported to the developing zone as the developing sleeve 11 is rotated, and participates in development.

The developed toner image is transferred onto transfer medium 25 transported by a transfer blade 27 which is transfer means impressed with transfer bias by a bias impressing means 26. The toner image transferred onto the transfer medium is fixed onto the transfer medium by a fixing unit not shown. Residual toner remaining on the photosensitive member, not consumed for transfer in the transfer step is adjusted for charge during the charging step, and collected during development.

Figure 3:
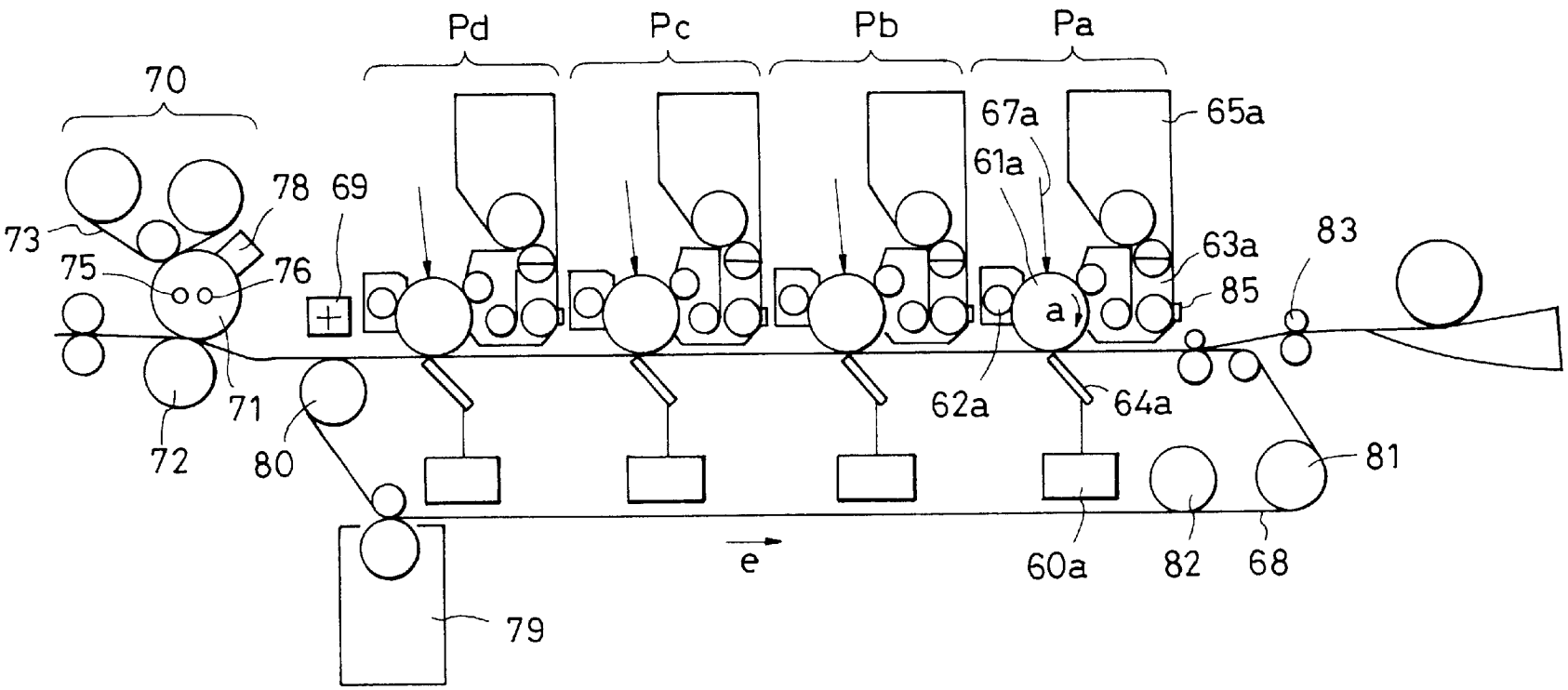
FIG. 3 is a schematic view illustrating another embodiment of the image forming apparatus of the invention.

FIG. 3 schematically illustrates still another image forming apparatus that can carry out the image forming method of the present invention.

The main body of the image forming apparatus is provided side by side with a first image forming unit Pa, a second image forming unit Pb, a third image forming unit Pc and a fourth image forming unit Pd, and images with respectively different colors are formed on a transfer medium through the process of latent image formation, development and transfer.

The respective image forming unit provided side by side in the image forming apparatus are each constituted as described below taking the first image forming unit Pa as an example.

The first image forming unit Pa has an electrophotographic photosensitive drum 61*a* of 30 mm diameter as the latent image bearing member. This photosensitive drum 61*a* is rotated in the direction of an arrow a. Reference numeral 62*a* denotes a primary charging assembly as a charging means. Reference numeral 67*a* denotes a laser beam irradiated by an exposure unit not showm for forming an electrostatic latent image on the photosensitive drum 61*a* whose surface has been uniformly charged by means of the primary charging assembly 62*a*. Reference numeral 63*a* denotes a developing assembly as a developing means for developing the electrostatic latent image held on the photosensitive drum 61*a*, to form a color toner image, which holds a color toner. Reference numeral 64*a* denotes a transfer blade as a transfer means for transferring the color toner image formed on the surface of the photosensitive drum 61*a*, to the surface of a transfer medium transported by a belt-like transfer medium carrying member 68. This transfer blade 64*a* comes into touch with the back of the transfer medium carrying member 68 and can apply a transfer bias.

In this first image forming unit Pa, the photosensitive drum 61*a* is uniformly primarily charged by the primary charging assembly 62*a*, and thereafter the electrostatic latent image is formed on the photosensitive drum 61*a* by the exposure means 67*a*. The electrostatic latent image is developed by the developing assembly 63*a* using a color toner. The toner image thus formed by development is transferred to the surface of the transfer medium by applying transfer bias from the transfer blade 64*a* coming into touch with the back of the belt-like transfer medium carrying member 68 carrying and transporting the transfer medium, at a first transfer zone (where the photosensitive drum 61*a* comes into contact with the transfer medium).

When the T/C ratio decrease as a result of consumption of the toner for development, the decrease is detected by the toner concentration detecting sensor 85 detecting a change in magnetic permeability of a developer by the use of inductance of a coil, and the replenishing toner 65*a* is supplied in an amount corresponding to the toner consumption. The toner concentration sensor 85 has therein a coil not shown.

In the image forming apparatus, the second image forming unit Pb, third image forming unit Pc and fourth image forming unit Pd, constituted in the same way as the first image forming unit pa but having respectively different color toners held in the developing assemblies, are provided side by side. For example, a yellow toner is used in the first image forming unit Pa, a magenta toner in the second image forming unit Pb, a cyan toner in the third image forming unit Pc and a black toner in the fourth image forming unit Pd, and the respective color toners are successively transferred to the transfer medium at the transfer zones of the respective image forming units. In this course, the respective color toners are superimposed while adjusting registration, on the same transfer medium every time the transfer medium moves once. After the transfer is completed, the transfer medium is separated from the surface of the transfer medium carrying member 68 by a separation charging assembly 69, and then sent to a fixing assembly 70 by a transport means such as a transport belt, where a final full-color image is formed by carrying out fixing just once.

The fixing assembly 70 has a 40 mm diameter fixing roller 71 and a 30 mm diameter pressure roller 72. The fixing roller 71 has heating means 75 and 76. Reference numeral 73 denotes a web for removing any stains on the fixing roller.

The unfixed color toner image transferred onto the transfer medium are passed through the pressure contact area between the fixing roller 71 and the pressure roller 72, whereupon they are fixed onto the transfer medium by the action of heat and pressure.

In the apparatus shown in FIG. 3, the transfer medium carrying member 68 is an endless belt-like member. This belt-like member is moved in the direction of an arrow e by a drive roller 80. Reference numeral 79 denotes a transfer belt cleaning device; 81, a belt follower roller; and 82, a belt charge eliminator. Reference numeral 83 denotes a pair of resist rollers for transporting to the transfer medium carrying member 68 the transfer medium kept in a transfer medium holder.

As the transfer means, the transfer blade coming into touch with the back of the transfer medium carrying member may be replaced with a contact transfer means that comes into contact with the back of the transfer medium carrying member and can directly apply a transfer bias, as exemplified by a roller type transfer roller.

The above contact transfer means may also be replaced with a non-contact transfer means that performs transfer by applying a transfer bias from a corona charging assembly provided in non-contact with the back of the transfer medium carrying member as commonly used.

However, in view of such an advantage that the quantity of ozone generated when the transfer bias is applied can be controlled, it is more preferable to use the contact transfer means.

Measuring methods used in the present invention will be described below.

(1) Measurement of Magnetic Properties of Carrier:

A BHU-60 type magnetization measuring device (manufactured by Riken Sokutei Co.) is used as an apparatus for measurement. About 1.0 of a sample for measurement is weighed and packed in a cell of 7 mm diameter and 10 mm high, which is then set in the above apparatus. Measurement is made while gradually increasing an applied magnetic field to be changed to 1,000 oersteds at the maximum. Subsequently, the applied magnetic field is decreased, and finally a hysteresis curve of the sample is obtained on a recording paper. $\sigma_{1000}$, and coercive force are determined therefrom.

(2) Measurement of Apparent Density:

Using a powder tester (manufactured by Hosokawa Micron Co.), sieve with 75 $\mu$m meshes is vibrated at a vibrational amplitude of 1 mm, and apparent density A ($g/cm^3$) is measured in the state the particles have been passed.

(3) Measurement of Degree of Compression

The tap density P after 180 up/down reciprocations was measured by means of a powder tester (manufactured by Hosokawa Micron Co.), and the degree of compression was calculated in accordance with the following formula:

$$\text{Degree of compression} = \frac{P - A}{P} \times 100(\%)$$

(where, A represents the apparent density measured by the method (2) above.)

(4) Measuring Method of SF-1 and SF-2 of Toner Particles, Carrier and External Additives A sample was enlarged by means of an FE-SEM (made by Hitachi Limited, S-800), and 100 samples on the enlarged image were sampled at random. The image information was introduced through an interface into, for example, an image analyzer of Nicole Co. (Luzex III) for analysis. The values calculated by the following formula were assumed to be the factors SF-1 and SF-2. In this measurement, enlargement was made at 10,000 magnifications for the toner particles, 2,000 magnifications for the carrier, and 100,000 magnifications for the external additives:

$$SF\text{-}1 = \frac{(MXLNG)^2}{AREA} \times \frac{\pi}{4} \times 100$$

(where, MXLNG represents the absolute maximum length of the particle, and AREA, the projected area of the particle.)

$$SF\text{-}2 = \frac{(PERI)^2}{AREA} \times \frac{1}{4\pi} \times 100$$

(where, PERI represents the circumferential length of the particle, and AREA, the projected area of the particle.)

(5) Measurement of Average Particle Diameter and Ratio of Longer to Shorter Diameters of the External Additives, and Number of External Additive Particles Present on the Toner Particle Surface Measurement of parameters of the inorganic oxide fine particles A was performed by the use of an enlarged photograph by taking a photograph of the toner particle surface enlarged to 100,000 magnifications by means of an FE-SEM (made by Hitachi Limited, S-800).

First, the average particle diameter of the inorganic oxide fine particle A was determined by measuring, over ten visual fields, the longer diameter of the inorganic oxide fine particle A in an enlarged photograph, and adopting an average value as the average particle diameter. Further, the average value of the shorter diameter of the inorganic oxide fine particle A was determined in a similar manner, and the ratio of longer to shorter diameters of the inorganic oxide fine particle A was determined. From among parallel lines drawn so as to be in contact with particles of the inorganic oxide fine particles A, the distance between the parallel lines giving the largest interval between the parallel lines is adopted as the longer diameter, and the distance between the parallel lines resulting in the smallest interval between the parallel lines, as the sorter diameter.

The number of the inorganic oxide fine particles A present on the toner particle surface was determined by counting, over ten visual fields of the enlarged photograph, the number of the inorganic oxide fine particles A per area of 0.5 $\mu$m×0.5 $\mu$m (50 mm×50 mm in the enlarged photograph of 100,000 magnifications) of the toner particle surface, and calculating an average value thereof. When counting the number of inorganic oxide fine particles A present in the form of primary or secondary particles, those present on a portion corresponding to 0.5 μm×0.5 μm at the center portion of the enlarged photograph were covered.

Parameters of the non-spherical inorganic oxide fine particles B was measured by taking a photograph of the toner particle surface enlarged to 30,000 magnifications by means of an FE-SEM (made by Hitachi Limited), and using the resultant enlarged photograph.

The average particle diameter of the non-spherical inorganic oxide fine particles B was determined by measuring, over ten visual fields, the longer diameter of the non-spherical inorganic oxide fine particles B in the enlarged photograph, and adopting the average value thereof as the average particle diameter. Similarly, the average value of the shorter diameter of the non-spherical inorganic oxide fine particles B was determined, and thus the ratio of the longer to shorter diameters of the non-spherical inorganic oxide fine particles B was determined. From among parallel lines drawn so as to be in contact with the non-spherical inorganic oxide fine particles B, the distance between parallel lines giving the largest interval between parallel lines was adopted as the longer diameter, and the distance between parallel lines giving the smallest intervals between parallel lines was adopted as the shorter diameter.

The number of non-spherical inorganic oxide fine particles B present on the toner particle surface was determined by counting, over ten visual fields, the number of non-spherical inorganic oxide fine particles B per area of 1.0 μm×1.0 μm (30mm×30 mm in the enlarged photograph of 30,000 magnifications) of the toner particle surface, and calculating the average value thereof. When counting the number of non-spherical inorganic oxide fine particles B, the non-spherical inorganic oxide fine particles present on a portion corresponding to 1.0 μm×1.0 μm at the center portion of the enlarged photograph were covered.

(6) Measurement of Average Particle Diameter and Particle Size Distribution of Toner Particle and Carrier:

In the average particle diameter and particle size distribution of the toner particle and carrier, such Coulter counter Model TA-II and Coulter Multisizer (manufactured by Coulter Electronics, Inc.) is used. An interface (manufactured by Nikkaki K.K.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (Coulter Scientific Japan Co.) may be used. Measurement is carried out by adding as a dispersant from 0.1 to 5 ml of a surface active agent (preferably an alkylbenzene sulfonate), to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with diameters of not smaller than 2 μm by means of the above Coulter Multisizer, using an aperture of 100 μm as its aperture. Then the values according to the present invention are determined, which are the volume-based, weight average particle diameter (D4) determined from the volume distribution, the number-based, length average particle diameter (D1) determined from number distribution.

Figure 4:
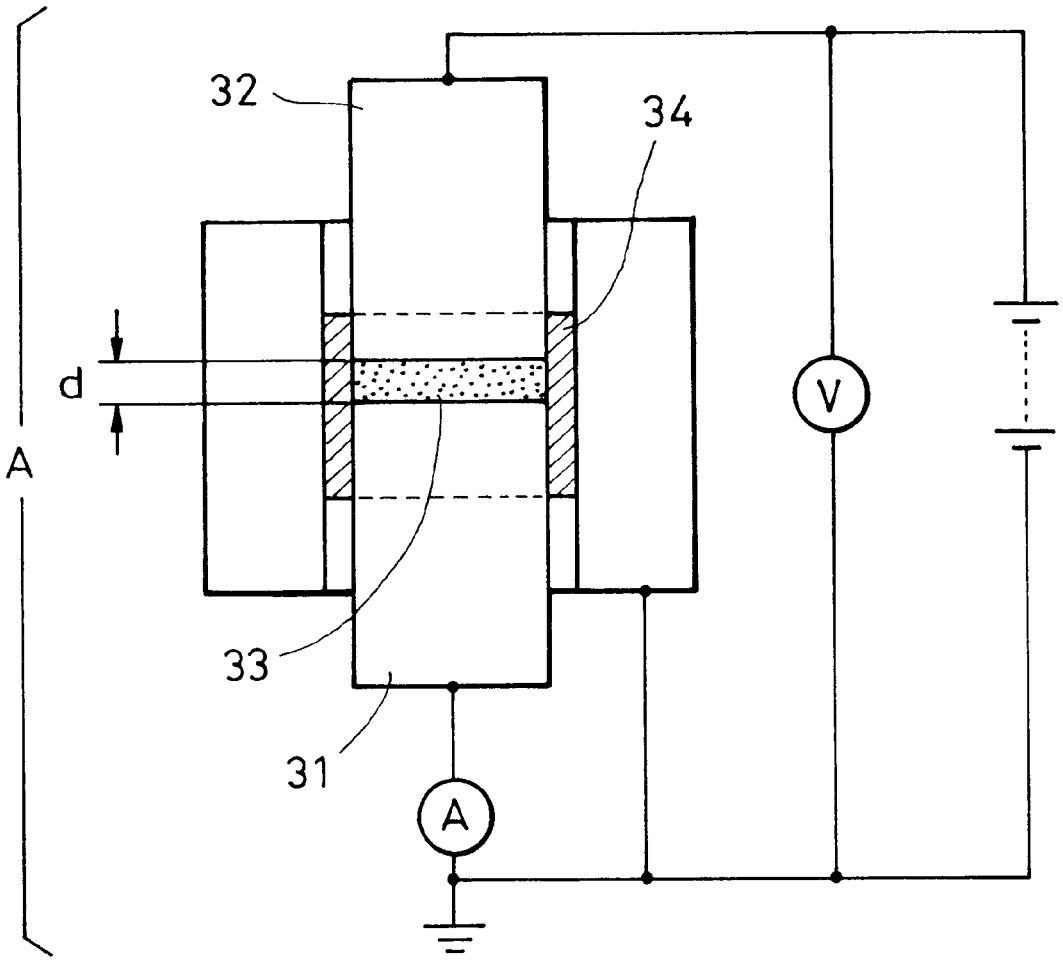
FIG. 4 is a schematic view of a cell used for the measurement of a volume resistivity value.

(7) Measurement of Volume Resistivities of Development Magnetic Carrier and Charging Conductive Magnetic Particles:

The volume resistivity is measured using the cell shown in FIG. 4. More specifically, the cell A is packed with the sample 33 and the electrodes 31 and 32 are so provided as to come into contact with the sample 33, where a 1,000 V DC voltage is applied across the electrodes and the currents flowing at that time are measured using the ammeter. Then, sample 34 is insulator. The measurement is made under conditions of contact area S between the packed sample 33 and the cell; 2 $cm^2$; thickness d: 3 mm; and load of the upper electrode: 15 kg.

(8) Measurement of BET Specific Surface area of External Additives

The BET specific surface area was measured by means of an Autosope 1, the specific surface area meter manufactured by QUANTACHROME Co.

A sample in an amount of about 0.1 g was weighed and deaerated at a temperature of 40° C., in vacuum of under 1.0 $\times 1.0^{-3}$ mmHg for 12 hours. Then, the sample was caused to adsorb nitrogen gas in a state cooled by liquid nitrogen, and a BET specific surface area was determined by the multi-point method.

EXAMPLE

Examples of the present invention are given below. The present invention is by no means limited to these. In the following, "part(s)" refers to "part(s) by weight".

Cyan toner Production Example 1

In 710 parts of ion-exchanged water, 450 parts of an aqueous 1M $Na_3PO_4$ solution was introduced, followed by heating to 60° C. and then stirring at 12,000 rpm using a TK-type homomixer (manufactured by Tokushu Kika Kogyo Co., Ltd.). To the resultant mixture, 68 parts of an aqueous 1.0M $CaCl_2$ solution was added little by little to obtain an aqueous medium containing $Ca_3(PO_4)_2$.

| | |
|---|---|
| (Monomers) | |
| Styrene | 165 parts |
| n-Butyl acrylate | 35 parts |
| (Colorant) | |
| C.I. Pigment Blue 15:3 | 15 parts |
| (Charge control agent) | |
| Salicylic acid metal compound | 2 parts |
| (Polar resin) | |
| Saturated polyester resin | 10 parts |
| (Release agent) | |
| Ester wax (m.p.: 70° C.) | 50 parts |

Materials formulated as above were heated to 60° C., followed by uniform dissolution and dispersion at 12,000 rpm using a TK-type homomixer (manufactured by Tokushu Kika Kogyo Co., Ltd.). In the mixture obtained, 10 parts of a polymerization initiator 2,2'-azobis(2,4-dimethylvaleronitrile) was dissolved. Thus, a polymerizable monomer composition was prepared.

The above polymerizable monomer composition was introduced in the above aqueous medium, followed by stirring at 60° C. in an atmosphere of nitrogen, using the TK homomixer at 10,000 rpm for 10 minutes to granulate the polymerizable monomer composition. Thereafter, its temperature was raised to 80° C. while stirring with a paddle agitating blade, and the reaction was carried out for 10 hours. After the polymerization was completed, residual monomers were evaporated off under reduced pressure, the reaction system was cooled, and thereafter hydrochloric acid was added thereto to dissolve the calcium phosphate, followed by filtration, washing with water and then drying to obtain sharp toner particles with a weight average particle diameter of 6.5 μm. The toner particles 1 had shape factors SF-1 of 114 and SF-2 of 107.

Anatase type hydrophobic titanium oxide ($7\times10^9$ Ωcm) having a BET specific surface area of 96 $m^2/g$ and treated with 10 parts isobutyltrimethoxysilane in an aqueous medium in an amount of 1.0 part and 1.0 part non-spherical silica fine particles generated by combination of a plurality of silica fine particles having an average primary particle diameter of 60 mμm treated with 10 parts hexamethyldisilazane and having a BET specific surface area of 43 $m^2/g$ were externally added to 100 parts of the resultant toner particles, thereby obtaining a cyan toner 1. The cyan toner 1 was photographed into an enlarged size through an electron microscope, and physical properties and the number of the external additives on the cyan toner 1 were investigated. The result is shown in Table 1.

The aforesaid non-spherical silica fine particles were prepared by surface-treating commercially available silica fine particles #50 (made by Nihon Aerogil Co.) in an amount of 100 parts with 10 parts of hexamethyldisilazane, then subjecting the same to a particle size distribution adjustment by collecting relatively coarse particles by means of an air classifier. The non-spherical silica fine particles were confirmed to be particles formed by combination of a plurality of primary particles having an average primary particle diameter of 60 mμm in an enlarged photograph to 100,000 magnifications taken through a transmission type electron microscope (TEM) and an enlarged photograph to 30,000 magnifications taken through a scanning type electron microscope (SEM). The resultant non-spherical silica fine particles had a shape as shown in FIG. 6.

Cyan Toner Production Example 2

| | |
|---|---|
| Polyester resin obtained by condensation of Propoxylated bisphenol and fumaric acid | 100 parts |
| Phthalocyanine pigment | 4 parts |
| Aluminum compound of di-tert-butylsalicylic acid | 4 parts |
| Low-molecular weight polypropylene | 4 parts |

The above materials were thoroughly premixed using a Henschel mixer, and then melt-kneaded using twin-screw extruder. After cooled, the kneaded product was crushed using a hammer mill to give coarse particles of about 1 to 20 mm in diameter, which were then finely pulverized using a fine grinding mill of an air-jet system. The finely pulverized product thus obtained was further classified and thereafter treated by mechanical impact to make spherical by means of a hybridizer (made by Nara Kikai Co.). Toner particles 2 having a weight average particle diameter of 6.3 μm, an SF-1 of 130 and an SF-2 of 135 were obtained. External additives were added in the same manner as in Production Example 1, and a cyan toner 2 was obtained. Cyan toner 2 was observed with an electron microscope. The result is shown is Table 1.

Cyan Toner Production Example 3

Toner particles 3 with a weight average particle diameter of 6.5 μm, an SF-1 of 114 and SF-2 of 107 were obtained in the same manner as in Cyan Toner Production Example 2 except that 2 parts of hydrophobic titanium oxide were used and non-spherical silica fine particles were not used, and further cyan toner 3 was obtained. Cyan toner 3 was observed with an electron microscope. The result is shown in Table 1.

Cyan Toner Production Example 4

Toner particles 4 with a weight average particle diameter of 6.6 μm, SF-1 of 114 and an SF-2 of 107 were obtained in the same manner as in Cyan Toner production Example 2 except that 2 parts of non-spherical silica fine particles were used and hydrophobic titanium oxide was not used, and cyan toner 4 was obtained. Cyan toner 4 was observed with an electron microscope. The result is shown in Table 1.

Cyan Toner Production Example 5

Toner particles 5 were obtained and further cyan toner 5 was obtained in the same manner as in Cyan Toner Production Example 1 except that anatase type titanium oxide ($4\times10^{11}$ Ωcm) having a BET specific surface area of 88 $m^2/g$, treated with alumina and then with isobutyltrimethoxysilane was used in place of titanium oxide used in Cyan Toner Production Example 1. Toner particles 5 had a weight average particle diameter of 6.1 μm, an SF-1 of 115 and an SF-2 of 108. Cyan toner 5 was observed with an electron microscope. The result is shown Table 1.

Cyan Toner Production Example 6

Toner particles 6 were obtained and further cyan toner 6 was obtained in the same manner as in Cyan Toner Production Example 1 except that non-spherical silica fine particles having a BET specific surface area of 35 $m^2/g$, treated 20 parts of dimethyl silicone oil of 100 centipoise, generated through combination of a plurality of silica fine particles having an average primary particle diameter of 70 mμm were used in place of the non-spherical silica fine particles used in Cyan Toner Production Example 1. Toner particles 6 had a weight average particle diameter of 6.1 μm, an SF-1 of 115 and an SF-2 of 107. Cyan toner 6 was observed with an electron microscope. The result is shown Table 1.

Cyan Toner Production Example 7

Toner particles 7 having a weight average particle diameter of 6.5 μm, an SF-1 of 114 and an SF-2 of 108 were obtained in the same manner as in Cyan Toner Production Example 1 except that low-temperature-baked alumina having a BET specific surface area of 130 $m^2/g$ was used in place of titanium oxide used in Cyan Toner Production Example 1, and further, cyan toner 7 was prepared. Cyan toner 7 was observed with an electron microscope. The result is shown in Table 1.

Cyan Toner Production Example 8

Toner particles 8 having a weight average particle diameter of 6.5 μm, an SF-1 of 114 and an SF-2 of 107 were obtained in the same manner as in Cyan Toner Production Example 1 except that high-temperature-baked titanium oxide having a BET specific surface area of 65 $m^2/g$ was used in place of titanium oxide used in Cyan Toner Production Example 1, and further, cyan toner 8 was prepared. Cyan toner 8 was observed with an electron microscope. The result is shown in Table 1.

Cyan Toner Production Example 9

Toner particles 9 having a weight average particle diameter of 6.5 μm, an SF-1 of 115 and an SF-2 of 108 were obtained in the same manner as in Cyan Toner Production Example 1 except that titanium oxide, treated with 500 cp silicone oil, having a BET specific surface area of 25 $m^2/g$ was used in place of titanium oxide used in Cyan Toner Production Example 1, and further, cyan toner 9 was prepared. Cyan toner 9 was observed with an electron microscope. The result is shown in Table 1.

Cyan Toner Production Example 10

Toner particles 10 having a weight average particle diameter of 6.5 $\mu$m, an SF-1 of 115 and an SF-2 of 107 were obtained in the same manner as in Cyan Toner Production Example 1 except that titanium oxide, treated with 3,000 cp silicone oil, having a BET specific surface area of 70 $m^2/g$ was used in place of titanium oxide used in Cyan Toner Production Example 1, and further, cyan toner 10 was prepared. Cyan toner 10 was observed with an electron microscope. The result is shown in Table 1.

Cyan Toner Production Example 11

Toner particles 11 having a weight average particle diameter of 6.5 $\mu$m, an SF-1 of 115 and an SF-2 of 108 were obtained in the same manner as in Cyan Toner Production Example 1 except that non-spherical silica fine particles, having a BET specific surface area of 100 $m^2/g$, treated with 5 parts of hexamethyldisilazane were used in place of non-spherical silica fine particles used in Cyan Toner Production Example 1, and further, cyan toner 11 was prepared. Cyan toner 11 was observed with an electron microscope. The result is shown in Table 1.

Cyan Toner Production Example 12

Toner particles 12 having a weight average particle diameter of 6.5 $\mu$m, an SF-1 of 115 and an SF-2 of 108 were obtained in the same manner as in Cyan Toner Production Example 1 except that non-spherical silica fine particles, having a BET specific surface area of 20 $m^2/g$, treated with 3000 cp silicone oil was used in place of non-spherical silica fine particles used in Cyan Toner Production Example 1, and further, cyan toner 12 was prepared. Cyan toner 12 was observed with an electron microscope. The result is shown in Table 1.

Cyan Toner Production Example 13

Toner particles 13 having a weight average particle diameter of 6.5 $\mu$m, an SF-1 of 115 and an SF-2 of 107 were obtained in the same manner as in Cyan Toner Production Example 1 except that non-spherical silica fine particles, having a BET specific surface area of 300 $m^2/g$, treated with 10 parts of hexamethyldisilazane and 10 parts of 100 cp dimethyl silicone oil in place of non-spherical silica fine particles used in Cyan Toner Production Example 1, and further, cyan toner 13 was prepared. Cyan toner 12 was observed with an electron microscope. The result is shown in Table 1.

Cyan Toner Production Example 14

Toner particles 14 having a weight average particle diameter of 6.5 $\mu$m, an SF-1 of 114 and an SF-2 of 107 were obtained in the same manner as in Cyan Toner Production Example 1 except that non-spherical silica fine particles, having a BET specific surface area of 46 $m^2/g$, pulverized on a jet mill were used in place of non-spherical silica fine particles used in Cyan Toner Production Example 1, and further, cyan toner 14 was prepared. Cyan toner 14 was observed with an electron microscope. The result is shown in Table 1.

Cyan Toner Production Example 15

Toner particles 15 having a weight average particle diameter of 9.5 $\mu$m, an SF-1 of 145 and an SF-2 of 160 were obtained in the same manner as in Cyan Toner Production Example 2 except that a spheroidizing treatment was not applied, and further, cyan toner 15 was prepared. The average particle diameter of the external additives, SF-1, and the number of particles present were the same as in Example 2.

Cyan Toner Production Example 16

Toner particles 16 having a weight average particle diameter of 6.5 $\mu$m, an SF-1 of 115 and an SF-2 of 107 were obtained in the same manner as in Cyan Toner Production Example 1 except that the amount of added titanium oxide was changed to 0.02 parts, and further, cyan toner 16 was prepared. Cyan toner 16 was observed with an electron microscope. The result is shown in Table 1.

Cyan Toner Production Example 17

Toner particles 17 having a weight average particle diameter of 6.5 $\mu$m, an SF-1 of 116 and an SF-2 of 108 were obtained in the same manner as in Cyan Toner Production Example 1 except that the amount of added non-spherical silica fine particles was changed to 2.5 parts, and further, cyan toner 17 was prepared. Cyan toner 17 was observed with an electron microscope. The result is shown in Table 1.

TABLE 1

| | (A)<br>(B) | Treating agent | Amount of addition (parts) | BET surface surface area ($m^2/g$) | Average particle diameter (m$\mu$m) | Longer dia. /shorter dia. | SF-1 | Number present |
|---|---|---|---|---|---|---|---|---|
| Cyan toner 1 | Titanium oxide | Isobutyltrimethoxysilane | 1 | 96 | 50 | 1.1 | 121 | 75 |
| | Fine silica powder | Hexamethyldisilazane | 1 | 43 | 190 | 3.2 | 155 | 17 |
| Cyan toner 2 | Titanium oxide | Isobutyltrimethoxysilane | 1 | 96 | 50 | 1.1 | 121 | 32 |
| | Fine silica powder | Hexamethyldisilazane | 1 | 43 | 190 | 3.2 | 155 | 15 |
| Cyan toner 3 | Titanium oxide | Isobutyltrimethoxysilane | 2 | 96 | 50 | 1.1 | 121 | 155 |
| | — | — | — | — | — | — | — | — |
| Cyan toner 4 | — | — | — | — | — | — | — | — |
| | Fine silica powder | Hexamethyldisilazane | 2 | 43 | 190 | 3.2 | 155 | 35 |
| Cyan toner 5 | Titanium oxide | Alumina, Isobutyltrimethoxysilane | 1 | 88 | 50 | 1.1 | 129 | 56 |
| | Fine silica powder | Hexamethyldisilazane | 1 | 43 | 190 | 3.2 | 155 | 17 |
| Cyan toner 6 | Titanium oxide | Isobutyltrimethoxysilane | 1 | 96 | 50 | 1.1 | 121 | 73 |
| | Fine silica powder | Dimethyl silicone oil | 1 | 35 | 230 | 3.7 | 175 | 8 |

TABLE 1-continued

| | (A) (B) | Treating agent | Amount of addition (parts) | BET surface surface area ($m^2/g$) | Average particle diameter (mμm) | Longer dia. /shorter dia. | SF-1 | Number present |
|---|---|---|---|---|---|---|---|---|
| Cyan toner 7 | Alumina | Isobutyltrimethoxysilane | 1 | 130 | 16 | 1.1 | 130 | 95 |
| | Fine silica powder | Hexamethyldisilazane | 1 | 43 | 190 | 3.2 | 155 | 16 |
| Cyan toner 8 | Titanium oxide | Isobutyltrimethoxysilane | 1 | 65 | 90 | 1.2 | 108 | 10 |
| | Fine silica powder | Hexamethyldisilazane | 1 | 43 | 190 | 3.2 | 155 | 16 |
| Cyan toner 9 | Titanium oxide | Silicone oil | 1 | 25 | 110 | 1.3 | 113 | 8 |
| | Fine silica powder | Hexamethyldisilazane | 1 | 43 | 190 | 3.2 | 155 | 17 |
| Cyan toner 10 | Titanium oxide | Silicone oil | 1 | 70 | 75 | 4.3 | 133 | 55 |
| | Fine silica powder | Hexamethyldisilazane | 1 | 43 | 190 | 3.2 | 155 | 16 |
| Cyan toner 11 | Titanium oxide | Isobutyltrimethoxysilane | 1 | 96 | 50 | 1.1 | 121 | 77 |
| | Fine silica powder | Hexamethyldisilazane | 1 | 100 | 105 | 3.0 | 132 | 33 |
| Cyan toner 12 | Titanium oxide | Isobutyltrimethoxysilane | 1 | 96 | 50 | 1.1 | 121 | 75 |
| | Fine silica powder | Silicone oil | 1 | 20 | 650 | 5.0 | 210 | 5 |
| Cyan toner 13 | Titanium oxide | Isobutyltrimethoxysilane | 1 | 96 | 50 | 1.1 | 121 | 76 |
| | Fine silica powder | Hexamethyldisilazane, Dimethyl silicone oil | 1 | 30 | 230 | 5.3 | 155 | 12 |
| Cyan toner 14 | Titanium oxide | Isobutyltrimethoxysilane | 1 | 96 | 50 | 1.1 | 121 | 73 |
| | Fine silica powder | Hexamethyldisilazane | 1 | 46 | 170 | 2.8 | 140 | 18 |
| Cyan toner 15 | Titanium oxide | Isobutyltrimethoxysilane | 1 | 96 | 50 | 1.1 | 121 | 75 |
| | Fine silica powder | Hexamethyldisilazane | 1 | 43 | 190 | 3.2 | 155 | 17 |
| Cyan toner 16 | Titanium oxide | Isobutyltrimethoxysilane | 0.02 | 96 | 50 | 1.1 | 121 | 3 |
| | Fine silica powder | Hexamethyldisilazane | 1 | 43 | 190 | 3.2 | 155 | 16 |
| Cyan toner 17 | Titanium oxide | Isobutyltrimethoxysilane | 1 | 96 | 50 | 1.1 | 121 | 17 |
| | Fine silica powder | Hexamethylisilazane | 2.5 | 43 | 190 | 3.2 | 155 | 40 |

(Developing Carrier Production Example 1)

A spherical magnetic resin carrier core containing magnetic particles was obtained by mixing-dispersing phenol/formaldehyde monomers (50:50) in an aqueous medium, then uniformly dispersing 600 parts of a magnetic powder prepared by hydrophobic-treating magnetite particles, surface-treated with alumina, with isopropoxytriisostearoyl titanate and 400 parts of non-magnetic hematite particles hydrophobic-treated with isopropoxytriisostearoyl titanate, relative to the monomer weight, and polymerizing the monomers while appropriately adding ammonia.

A silicone varnish having a solid content of 10% was prepared, on the other hand, by placing 20 parts of toluene, 20 parts of butanol, 20 parts of water and 40 parts of ice in four square flasks, adding 40 parts of a mixture of $CH_3SiCl_3$ and $(CH_3)_2SiCl_2$ in a molar ratio of 3:2 and a catalyst while stirring, further stirring for 30 minutes, causing a condensation reaction at 60° C. for an hour, then washing siloxane sufficiently with water, and dissolving the same into a toluene-methylethylketone-butanol mixed solvent.

To this silicone varnish, there were simultaneously added, relative to 100 parts of solid content in siloxane, 2.0 parts of ion exchange water, 2.0 parts of the following hardening agent:

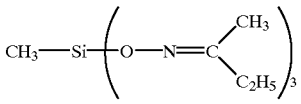

and 2 parts of the following aminosilane coupling agent:

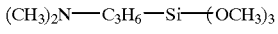

to prepare a carrier coating solution I.

This solution I was coated by means of a coater (SPIRA coater, made by Okada Seiko Co.) so that the amount of the resin coat is 1 part relative to 100 parts of the foregoing carrier core, thereby obtaining a developing carrier I.

This carrier had a volume resistivity of $4\times10^{13}$ Ωcm, a $\sigma_{1000}$ of 37 $Am^2$/kg, a coercive force of 55 oersted, a weight average particle diameter of 34 μm, an SF-1 of 115, and an SF-2 of 108.

(Developing Carrier Production Example 2)

The non-spherical silica fine particles used in Cyan Toner Production Example 1 in an amount of 0.02 parts relative to 100 parts of the developing carrier 1 was added and mixed to form a developing carrier II.

The volume resisting, magnetic properties, weight average particle diameter, SF-1 and SF-2 were the same as those of development carrier I.

Observation of the surface of developing carrier II enlarged with an electron microscope revealed that the non-spherical silica fine particles had an average particle diameter of 190 mμm, a longer/shorter diameter ratio of 3.2, and an SF-1 of 155.

(Developing Carrier Production Example 3)

Developing carrier III was obtained in the same manner as in Developing Carrier Production Example 2 except that 100 parts of magnetite were used in place of 600 parts of magnetic powder and 400 parts of non-magnetic hematite particles, and further, the amount of non-spherical silica fine particles was changed to 0.01 part.

Developing carrier III had a volume resistivity of $5\times10^{11}$ Ωcm, a $\sigma_{1000}$ of 61 $Am^2$/kg, a coercive force of 77 oersted, a weight average particle diameter of 33 μm, an SF-1 of 119 and SF-2 of 110.

Observation of the surface of developing carrier III enlarged with an electron microscope revealed that the non-spherical silica fine particles had an average particle diameter of 110 mμm, a longer/shorter diameter ratio of 3.2 and an SF-1 of 155.

(Developing Carrier Production Example 4)

Developing carrier IV was obtained in the same manner as in Developing Carrier Production Example 2 except that 0.02 parts of titanium oxide fine particles used in Cyan Toner Production Example 1 were added in place of the non-spherical silica fine particles.

Developing carrier IV had the same volume resistivity, magnetic properties, weight average particle diameter, SF-1 and SF-2 as those of developing carrier I.

Observation of the surface of developing carrier IV enlarged with an electron microscope revealed that titanium oxide fine particles had an average particle diameter of 50 mμm, a longer/shorter diameter ratio of 1.1 and an SF-1 of 121.

(Developing Carrier Production Example 5)

Styrene-methymethacrylate (70:30) copolymer: 30 parts

Magnetite (EPT-1000; made by Toda Kogyo Co.): 100 parts

The above components were melted and kneaded in a pressure kneader, pulverized and classified in a turbo mill and a classifier, 0.01 part of non-spherical silica fine particles used in Cyan Toner Production Example 1 was added thereto and mixed therewith, thereby obtaining non-spherical developing carrier V. Developing carrier V had a volume resistivity of $4\times10^9$ Ωcm, a $\sigma_{1000}$ of 57 $Am^2/kg$, a coercive force of 85 oersted, a weight average particle diameter of 37 μm, an SF-1 of 145 and SF-2 of 135.

Microscope observation of the surface of developing carrier V revealed that non-spherical silica fine particles had an average particle diameter of 190 mμm, a longer/shorter diameter ratio of 3.2 and an SF-1 of 155.

(Developing Carrier Production Example 6)

Developing carrier VI was obtained in the same manner as in Developing Carrier production Example 1 except that vinylidene fluoride-tetrafluoroethylene dopolymer/styrene-methylmethacrylate copolymer (50:50) are used in place of 40 aprts of mixture of $CH_3SiCl_3$ and $(CH_3)SiCl_2$.

Developing carrier VI had a volume resistivity of $7\times10^{13}$ Ωcm, a $\sigma_{1000}$ of 37 $Am^2/kg$, a coercive force of 55 oersted, a weight average particle diameter of 34 μm, an SF-1 of 115 and an SF-2 of 109.

(Developing Carrier Production Example 7)

Developing carrier VII was obtained in the same manner as in Developing Carrier Production Example 2 except that the polymerization conditions were changed. Developing carrier VII had a volume resistivity of $8\times10^{13}$ Ωcm, a $\sigma_{1000}$ of 37 $Am^2/kg$, a coercive force of 45 oersted, a weight average particle diameter of 55 μm, an SF-1 of 114 and an SF-2 of 107.

Microscope observation of the surface of developing carrier VII revealed that the non-spherical silica fine particles had an average particle diameter of 190 mμm, a longer/shorter diameter ratio of 3.2, and an SF-1 of 155.

(Developing Carrier Production Example 8)

Developing carrier VIII was obtained in the same manner as in Developing Carrier Production Example 2 except that the polymerization conditions were changed. Developing carrier VIII had a volume resistivity of $7\times10^{12}$ Ωcm, a $\sigma_{1000}$ of 37 $Am^2/kg$, a coercive force of 75 oersted, a weight average particle diameter of 18 μm, an SF-1 of 120 and an SF-2 of 118.

Microscope observation of the surface of developing carrier VIII revealed that the non-spherical silica fine particles had an average particle diameter of 190 mμm, a longer/shorter diameter ratio of 3.2, and an SF-1 of 155.

(Developing Carrier Production Example 9)

Developing carrier IX was obtained in the same manner as in Developing Production Example 2 except that the polymerization conditions were changed. Developing carrier IX had a volume resistivity of $1\times10^{14}$ Ωcm, a $\sigma_{1000}$ of 37 $Am^2/kg$, a coercive force of 40 oersted, a weight average particle diameter of 65 μm, an SF-1 of 114 and an SF-2 of 107.

Microscope observation of the surface of developing carrier IX revealed that the non-spherical silica fine particles had an average particle diameter of 190 mμm, longer/shorter diameter ratio of 3.2 and an SF-1 of 155.

(Developing Carrier Production Example 10)

Developing carrier X was obtained in the same manner as in Developing Production Example 2 except that the polymerization conditions were changed. Developing carrier X had a volume resistivity of $5\times10^{10}$ Ωcm, a $\sigma_{1000}$ of 37 $Am^2/kg$, a coercive force of 90 oersted, a weight average particle diameter of 13 μm, an SF-1 of 127 and an SF-2 of 125.

Microscope observation of the surface of developing carrier X revealed that the non-spherical silica fine particles had an average particle diameter of 190 mμm, longer/shorter diameter ratio of 3.2 and an SF-1 of 155.

(Developing Carrier Production Example 11)

Developing carrier XI was obtained in the same manner as in Developing Production Example 2 except that magnetic particles not subjected to a hydrophobic treatment were used. Developing carrier XI had a volume resistivity of $7\times10^7$ Ωcm, a $\sigma_{1000}$ of 37 $Am^2/kg$, a coercive force of 50 oersted, a weight average particle diameter of 35 μm, an SF-1 of 135 and an SF-2 of 145.

Microscope observation of the surface of developing carrier XI revealed that the non-spherical silica fine particles had an average particle diameter of 190 mμm, longer/shorter diameter ratio of 3.2 and an SF-1 of 155.

(Developing Carrier Production Example 12)

Developing carrier XII was obtained in the same manner as in Developing Production Example 2 except that the carrier coating conditions were changed to include an amount of resin coat of 4 parts. Developing carrier XII had a volume resistivity of $2\times10^{15}$ Ωcm, a $\sigma_{1000}$ of 33 $Am^2/kg$, a coercive force of 40 oersted, a weight average particle diameter of 35 μm, an SF-1 of 120 and an SF-2 of 110.

Microscope observation of the surface of developing carrier XII revealed that the non-spherical silica fine particles had an average particle diameter of 190 mμm, longer/shorter diameter ratio of 3.2 and an SF-1 of 155.

(Developing Carrier Production Example 13)

Developing carrier XIII was obtained in the same manner as in Developing Production Example 2 except 600 parts of Mg—Mn—Fe ferrite fine particles were used in place of 600 parts of magnetic powder. Developing carrier XIII had a volume resistivity of 8×1012 Ωcm, a $\sigma_{1000}$ of 39 $Am^2/kg$, a coercive force of 7 oersted, a weight average particle diameter of 32 μm, an SF-1 of 118 and an SF-2 of 110.

Microscope observation of the surface of developing carrier XIII revealed that the non-spherical silica fine particles had an average particle diameter of 190 mμm, longer/shorter diameter ratio of 3.2 and an SF-1 of 155.

TABLE 2

| | External additive | Volume resistivity (Ωcm) | $\delta_{1000}$ ($Am^2/kg$) | Coercive force (oersted) | Weight average particle diameter (μm) | Ratio of particles under 22 μm (%) | Ratio of particles of at least 62 μm (%) | SF-1 | SF-2 |
|---|---|---|---|---|---|---|---|---|---|
| Developing carrier I | — | $4 \times 10^{13}$ | 37 | 55 | 34 | 0 | 0.1 | 115 | 108 |
| Developing carrier II | Non-spherical silica fine particle | $4 \times 10^{13}$ | 37 | 55 | 34 | 0 | 0.1 | 115 | 108 |
| Developing carrier III | Non-spherical silica fine particle | $5 \times 10^{11}$ | 61 | 77 | 33 | 0.1 | 0 | 119 | 110 |
| Developing carrier IV | Titanium oxide | $4 \times 10^{13}$ | 37 | 55 | 34 | 0 | 0.1 | 115 | 108 |
| Developing carrier V | Non-spherical silica fine particle | $4 \times 10^{9}$ | 57 | 85 | 37 | 2.5 | 1.3 | 145 | 135 |
| Developing carrier VI | — | $7 \times 10^{13}$ | 37 | 55 | 34 | 0 | 0.1 | 115 | 109 |
| Developing carrier VII | Non-spherical silica fine particle | $8 \times 10^{13}$ | 37 | 45 | 55 | 0 | 2.2 | 114 | 107 |
| Developing carrier VIII | Non-spherical silica fine particle | $7 \times 10^{12}$ | 37 | 45 | 18 | 92 | 0 | 120 | 118 |
| Developing carrier IX | Non-spherical silica fine particle | $1 \times 10^{14}$ | 37 | 45 | 65 | 0 | 63 | 114 | 107 |
| Developing carrier X | Non-spherical silica fine particle | $5 \times 10^{10}$ | 37 | 45 | 13 | 99 | 0 | 127 | 125 |
| Developing carrier XI | Non-spherical silica fine particle | $7 \times 10^{7}$ | 37 | 50 | 35 | 3.3 | 2.2 | 135 | 145 |
| Developing carrier XII | Non-spherical silica fine particle | $2 \times 10^{15}$ | 33 | 40 | 35 | 0 | 0.5 | 120 | 110 |
| Developing carrier XIII | Non-spherical silica fine particle | $8 \times 10^{12}$ | 39 | 7 | 32 | 0.3 | 0 | 118 | 110 |

(Charging Magnetic Particles Production Example)

A ferrite core with a $\sigma_{1000}$ of 60 $Am^2/kg$ and a coercive force 55 oersted having an average particle diameter of 28 μm was obtained by making finer 5 parts of MgO, 8 parts of MnO, 4 parts of SrO and 83 parts of $Fe_2O_3$, respectively, adding water and mixing, granulating the same, baking the same at 1,300° C., and adjusting the particle size.

The aforesaid core was surface-treated with a mixture of 10 parts of isopropoxytriisostearoyl titanate with 99 parts of hexane/1part of water so as to give 0.1 part, and magnetic particles a were obtained.

The resultant magnetic particles had a volume resistivity of $3\times10^7$ Ωcm and a weight loss by heat of 0.1 parts.

(Photosensitive member production Example)

The photosensitive member (latent image bearing member) comprises an organic photoelectric conductive material for negative charging, and five functional layers are provided on a cylinder having a diameter of 30 mm, made of aluminum.

The first layer is a conduction layer which is a conductive particle dispersion resin layer having a thickness of about 20 μm, provided for preventing occurrence of moire caused by reflection of laser exposure.

The second layer is a positive charge injection preventive layer (subbing layer), which is a medium resistance layer of about 1 μm thick, having the function to prevent the positive charges injected from the aluminum substrate, from cancelling the negative charges produced on the photosensitive member surface by charging, and having been adjusted to have a resistivity of about $10^6$ Ωcm using 6-66-610-12-nylon and methoxymethylated nylon.

The third layer is a charge generation layer, which is a layer of about 0.3 μm thick, formed of a resin with a disazo pigment dispersed therein and generates positive and negative charge pairs upon exposure to laser light.

The fourth layer is a charge transport layer, which is formed of a polycarbonate resin with hydrazone particles dispersed therein and is a p-type semiconductor. Thus the negative charges produced on the photosensitive member surface by charging can not move through this layer and only the positive charges generated in the charge generation layer can be transported to the photosensitive member surface.

The fifth layer is a charge injection layer, which is formed of a phtocurable acrylic resin in which ultrafine $SnO_2$ particles and, in order to elongate the time of contact of the charging member with the photosensitive member to enable uniform charging, tetrafluoroethylene resin particles with a particle diameter of about 0.25 μm have been dispersed. Stated specifically, based on the weight of the resin 160% by weight of oxygen-free type low-resistance $SnO_2$ particles with a particle diameter of about 0.03 μm and also 30% by weight of the tetrafluoroethylene resin particles and 1.2% by weight of a dispersant are dispersed.

The volume resistivity of the surface layer of photosensitive member thus pbtained was as low as $5\times10^{15}$ Ωcm, compared with that of the charge transport layer alone which was $6\times10^{11}$ Ωcm.

EXAMPLE 1

A cyan developer (degree of compression: 11%, apparent density: 1.47 $g/cm^3$) was prepared by mixing cyan toner 1 and developing carrier II at a toner concentration of 8 wt. %.

Figure 5:
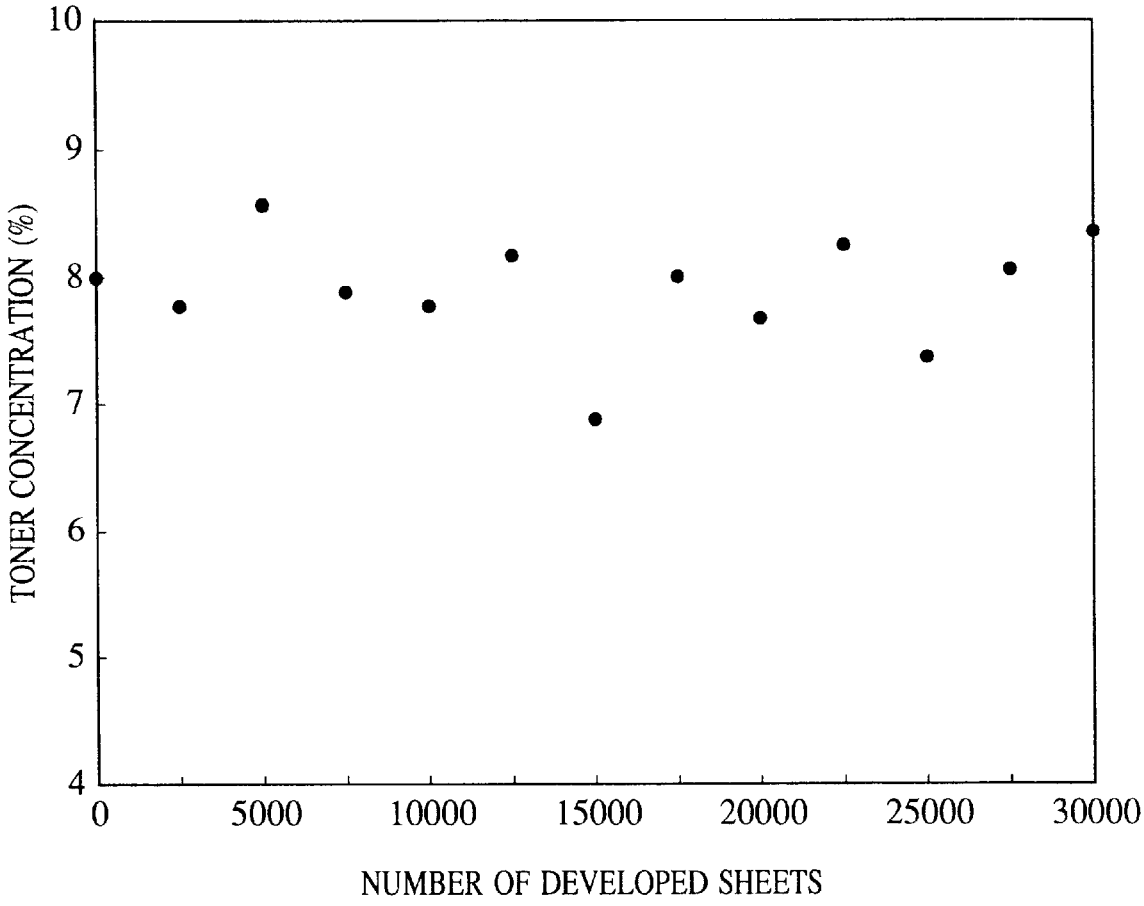
FIG. 5 illustrates progress of the toner concentration in the embodiment 1.

Then, the developing vessel and charging unit of a commercially available copying machine GP55 (made by Canon Co.) was modified as shown in FIG. 1. Magnetic particles a were used as the charging member. The charging member was caused to rotate at a circumferential speed of 120% of that of the photosensitive member in a direction counter to the photosensitive member 1. The photosensitive member 1 was charged by overlap-impressing DC/AC electric field (−700 V, 1 kHz/1.2 kVpp). The development contrast was set at 200 V, and the reverse contrast with fog was set at −150 V. By the use of the foregoing cyan developer and cyan toner 1 using the AC electric field shown in FIG. 2, development and transfer to a transfer medium were carried out. A non-fixed toner image on the transfer medium was fixed onto the transfer medium by means of a pressure-heating roller not shown in FIG. 1. The photosensitive member was cleaned by the development simultaneous cleaning process in which the residual toner after transfer is collected for reuse at the same time as development in the developing step. Setting was made so as to keep a toner concentration of 8 wt. % in the developer. Under the above-mentioned conditions in an environment of 23° C./65%, an original having an image area ratio of 20% was copied continuously onto 2,000 sheets of transfer medium. Then, an original having an image area ratio of 6% was copied onto 2,000 sheets. Thereafter, the original of the image area ratio of 20% and that of 6% were alternately copied continuously up to 30,000 sheets in total. During continuous copying, the toner concentration was measured every 2,500 sheets, and the bulk density of the developer was measured in the initial stage, at the 15,000th sheet and upon completion of 30,000 sheets. Simultaneously, the image density, fog and solid concentration blurs of the copied image were evaluated. Changes in the toner concentration throughout 30,000 copies are shown in FIG. 5.

The result of measurement of bulk density and other results of evaluation are shown in Table 3. The results shown in Table 3 suggest that control of the toner concentration is stably accomplished and a satisfactory image is stably available over a long period of time. Further, reuse of the toner is achieved with no problem.

EXAMPLE 2

An image was developed with a developer having a degree of compression of 16% and an apparent density of 1.47 g/cm$^3$ in the same manner as in Example 1 except for the use of developing carrier I. The toner concentration decreased during copying of an original of an image area ratio of 6%, with a slight decrease in the image density. A satisfactory image was however available.

This is considered attributable to the fact that, because no additive was previously added to the carrier, the original of a low consumption resulted in a smaller bulk density of the developer than in Example 1, and this is conjectured to have inhibited the amount of toner replenishment. The results of measurement and evaluation similar to those in Example 1 are shown in Table 3.

EXAMPLE 3

An image was developed in the same manner as in Example 1 except that the Cyan toner 2 was used and the developer had a degree of compression of 19%, and an apparent density of 1.43 g/cm$^3$. Upon use of an original of 20%, a satisfactory results were obtained apart from a slightly higher image concentration and a slight decrease in inhibition of fog. The results of measurement and evaluation similar to those in Example 1 are shown in Table 3.

Comparative Example 1

An image was developed in the same manner as in Example 3 except cyan toner 3 was used and the developer had a degree of compression of 20%, an apparent density of 1.38 g/cm$^3$. Since the image density decreased during the use of an original of 6%, and fog occurred frequently, the operation was discontinued upon completion of 15,000 sheets. Because non-spherical silica fine particles were not used as an external additive to the toner, titanium oxide serving as an external additive in the toner tended to be incorporated into the toner during the use of a low-consumption original, thus leading to deterioration of developability of the toner, and at the same time to a smaller bulk density of the developer. This is considered to have inhibited the amount of replenished toner. The results of measurement and evaluation similar to those in Example 1 are shown in Table 3.

Comparative Example 2

An image was developed in the same manner as in Example 3 except cyan toner 4 was used and the developer had a degree of compression of 21%, and an apparent density of 1.39 g/cm$^3$. During the use of an original of 20%, there occurred image density blurs with frequent occurrence of fog. The only external additive was non-spherical silica fine particles, and this made it impossible to achieve uniform mixing of the replenished toner during use of a high-consumption original, resulting in unstable control of the toner concentration. The results of measurement and evaluation similar to those in Example 1 are shown in Table 3.

EXAMPLE 4

An image was developed in the same manner as in Example 1 except that developing carrier III was used and the developer had a degree of compression of 12% and an apparent density-of 1.51 g/cm$^3$. Satisfactory results were obtained although there was a light decrease in image density during use of a 6% original. The results of measurement and evaluation similar to those in Example 1 are shown in Table 3.

Because of the increase in magnetic properties of the carrier, the low-consumption original probably acted to slightly increase the damage to the toner.

EXAMPLE 5

An image was developed in the same manner as in Example 1 except that developing carrier IV was used, with a degree of compression of 12% and an apparent density of 1.48 g/cm$^3$. Satisfactory result was obtained. The results of measurement and evaluation similar to those in Example 1 are shown in Table 3.

Comparative Example 3

An image was developed in the same manner as in Example 1 except that developing carrier V was used, with a degree of compression of 25% and an apparent density of 1.27 g/cm$^3$. Control of the toner concentration was not performed smoothly, and evaluation was discontinued upon completion of 5,000 sheets. A conceivable cause is that the non-spherical shape of the carrier resulted in a very large change in bulk density. The results of measurement and evaluation similar to those in Example 1 are shown in Table 3.

EXAMPLE 6

An image was developed in the same manner as in Example 1 except that developing carrier VI was used, with a degree of compression of 14% and an apparent density of 1.51 g/cm$^3$. Satisfactory results were obtained as a whole, although slight fogs were observed upon completion of 30,000 sheets. The results of measurement and evaluation similar to those in Example 1 are shown in Table 3.

EXAMPLE 7

An image was developed in the same manner as in Example 1 except that developing sleeve was rotated in a direction counter to that of the photosensitive drum in the developing section. Satisfactory results were obtained although there occurred slight solid density blurs.

By changing the direction of rotation of the developing sleeve, it become difficult to take balance between stripping of the developer after development and surface coating of fresh developer, thus somewhat impairing control of the toner concentration.

EXAMPLE 8

An image was developed in the same manner as in Example 1 except that cyan toner 5 was used and the developer had a degree of compression of 14% and an apparent density of 1.43 g/cm$^3$. Probably because SF-1 of titanium oxide increased, solid concentration blurs showed a slight deterioration, where as satisfactory results were obtained. The results of measurement and evaluation similar to those in Example 1 are shown in Table 3.

EXAMPLE 9

An image was developed in the same manner as in Example 1 except that cyan toner 6 was used and the developer had a degree of compression of 13% and an apparent density of 1.50 g/cm$^3$. Satisfactory results were obtained, although, probably because of a decrease in SF-1 of silica, there were apparent fluctuations of the toner concentration, resulting larger variations of the image density. The results of measurement and evaluation similar to those in Example 1 are shown in Table 3.

EXAMPLE 10

An image was developed in the same manner as in Example 1 except that cyan toner 7 was used and the developer had a degree of compression of 13% and an apparent density of 1.43 g/cm$^3$. A satisfactory image was obtained although slight solid concentration blurs were observed as compared with Example 1 upon completion of 30,000 sheets of transfer. The results of measurement and evaluation similar to those in Example 1 are shown in Table 3.

EXAMPLE 11

An image was developed in the same manner as in Example 1 except that cyan toner 8 and developing carrier VII were used and the developer had a degree of compression of 12% and an apparent density of 1.49 g/cm$^3$. Since the toner concentration was generally lower than in Example 1, there was a slight decrease in image density. However, satisfactory result was obtained with no solid concentration blurs. The results of measurement and evaluation similar to those in Example 1 are shown in Table 3.

EXAMPLE 12

An image was developed in the same manner as in Example 11 except that cyan toner 9 was used and the developer had a degree of compression of 13% and an apparent density of 1.44 g/cm$^3$. As compared with Example 11, slight fog was observed, whereas the results were satisfactory as a whole. The results of measurement and evaluation similar to those in Example 1 are shown in Table 3.

Comparative Example 4

An image was developed in the same manner as in Example 11 except that cyan toner 10 was used and the developer had a degree of compression of 13% and an apparent density of 1.41 g/cm$^3$. satisfactory in that solid concentration blurs were more apparent than in Example 11. The results of measurement and evaluation similar to those in Example 1 are shown in Table 3.

Comparative Example 5

An image was developed in the same manner as in Example 11 except that cyan toner 11 was used and the developer had a degree of compression of 18% and an apparent density of 1.50 g/cm$^3$. There occurred serious variations in toner concentration, and the results were not satisfactory in fog and solid concentration blurs. The results of measurement and evaluation similar to those in Example 1 are shown in Table 3.

EXAMPLE 13

An image was developed in the same manner as in Example 11 except that cyan toner 12 was used and the developer had a degree of compression of 11% and an apparent density of 1.39 g/cm$^3$. The results were satisfactory as a whole, although fog and solid concentration blurs were slightly more apparent than in Example 11. The results of measurement and evaluation similar to those in Example 1 are shown in Table 3.

EXAMPLE 14

An image was developed in the same manner as in Example 11 except that cyan toner 13 was used and the developer had a degree of compression of 12% and an apparent density of 1.41 g/cm$^3$. Except for some fogs, the results were satisfactory. The results of measurement and evaluation similar to those in Example 1 are shown in Table 3.

Comparative Example 6

An image was developed in the same manner as in Example 11 except that cyan toner 14 was used and the developer had a degree of compression of 20% and an apparent density of 1.52 g/cm$^3$. A serious fluctuation of toner concentration caused apparent solid concentration blurs. The results of measurement and evaluation similar to those in Example 1 are shown in Table 3.

EXAMPLE 15

An image was developed in the same manner as in Example 11 except that cyan toner 15 was used and the developer had a degree of compression of 13% and an apparent density of 1.52 g/cm$^3$. The results were satisfactory in spite of a slight deterioration of solid concentration blurs as compared with Example 11. The results of measurement and evaluation similar to those in Example 1 are shown in Table 3.

EXAMPLE 16

An image was developed in the same manner as in Example 11 except that cyan toner 16 was used and the developer had a degree of compression of 14% and an apparent density of 1.42 g/cm$^3$. Satisfactory results were obtained although some fogs are observed as compared with Example 11. The results of measurement and evaluation similar to those in Example 1 are shown in Table 3.

EXAMPLE 17

An image was developed in the same manner as in Example 11 except that cyan toner 17 was used and the developer had a degree of compression of 11% and an apparent density of 1.43 g/cm$^3$. Good results were obtained, although solid concentration blurs somewhat worsened as compared with Example 11. The results of measurement and evaluation similar to those in Example 1 are shown in Table 3.

EXAMPLE 18

An image was developed in the same manner as in Example 11 except that developing carrier VIII was used and the developer had a degree of compression of 15% and an apparent density of 1.47 g/cm$^3$. The carrier tended to adhere to the photosensitive member with some slight fogs, the results were satisfactory as a whole. The results of measurement and evaluation similar to those in Example 1 are shown in Table 3.

Comparative Example 7

An image was developed in the same manner as in Example 11 except that developing carrier IX was used and the developer had a degree of compression of 13% and an apparent density of 1.52 g/cm$^3$. Both fog and solid concentration blurs were more apparent than in Example 11. The results of measurement and evaluation similar to those in Example 1 are shown in Table 3.

Comparative Example 8

An image was developed in the same manner as in Example 11 except that developing carrier X was used and the developer had a degree of compression of 17% and an apparent density of 1.42 g/cm$^3$. The carrier deposited onto the photosensitive member in a large quantity, so that operation was discontinued. The results of measurement and evaluation similar to those in Example 1 are shown in Table 3.

EXAMPLE 19

An image was developed in the same manner as in Example 11 except that developing carrier XI was used and the developer had a degree of compression of 12% and an apparent density of 1.46 g/cm$^3$. As compared with Example 11, both fog and solid concentration blurs are slightly more serious, but the results were satisfactory as a whole. The results of measurement and evaluation similar to those in Example 1 are shown in Table 3.

EXAMPLE 20

An image was developed in the same manner as in Example 11 except that developing carrier XII was used and the developer had a degree of compression of 13% and an apparent density of 1.45 g/cm$^3$. Although the image density was somewhat lower than in Example 11, the results were satisfactory. The results of measurement and evaluation similar to those in Example 1 are shown in Table 3.

EXAMPLE 21

An image was developed in the same manner as in Example 11 except that developing carrier XIII was used and the developer had a degree of compression of 12% and an apparent density of 1.52 g/cm$^3$. Satisfactory results were obtained. The results of measurement and evaluation similar to those in Example 1 are shown in Table 3.

EXAMPLE 22

An yellow developer, a magenta developer and a black developer were prepared in the same manner as in Example 1 except that colorants in the cyan developer used in Example 1 was changed. Using these three color developers and the cyan developer used in Example 1 were used in an image forming apparatus having the configuration shown in FIG. 3, and the images were transferred onto 30,000 sheets of transfer medium in a sequence of yellow, magenta, cyan and then black. There were only slight changes in image density, and thus giving a satisfactory full-collor image in which fog is inhibited.

TABLE 3

| | Toner | Carrier | Bulk density Initial/15000/30000 | Toner concentration (%) | Image density Initial/15000/30000 | Fog (%) Initial/15000/30000 | Solid image blurs Initial/15000/30000 |
|---|---|---|---|---|---|---|---|
| Example 1 | 1 | II | 1.47/1.45/1.45 | 6.9–8.6 | 1.5/1.5/1.5 | 0.2/0.2/0.2 | 0.02/0.02/0.03 |
| Example 2 | 1 | I | 1.47/1.40/1.41 | 6.5–8.7 | 1.5/1.4/1.5 | 0.2/0.2/0.2 | 0.02/0.04/0.06 |
| Example 3 | 2 | II | 1.43/1.45/1.43 | 6.9–9.3 | 1.5/1.5/1.6 | 0.2/0.4/0.5 | 0.02/0.03/0.05 |
| Comparative Example 1 | 3 | II | 1.38/1.20/— | 6.0–8.9 | 1.5/1.2/— | 0.2/0.9/— | 0.02/0.05/— |
| Comparative Example 2 | 4 | II | 1.39/1.42/1.45 | 6.5–10.3 | 1.5/1.5/1.7 | 0.2/0.5/1.1 | 0.02/0.04/0.15 |
| Example 4 | 1 | III | 1.51/1.48/1.45 | 6.7–9.5 | 1.5/1.4/1.6 | 0.2/0.4/0.3 | 0.02/0.04/0.04 |
| Example 5 | 1 | IV | 1.48/1.45/1.42 | 6.7–9.0 | 1.5/1.5/1.6 | 0.2/0.4/0.4 | 0.02/0.04/0.05 |
| Comparative Example 3 | 1 | V | 1.27/— | 5.8–10.2 | 1.3/— | 0.5/— | 0.09/— |
| Example 6 | 1 | VI | 1.46/1.45/1.42 | 6.5–9.3 | 1.5/1.5/1.6 | 0.2/0.4/0.7 | 0.02/0.04/0.06 |
| Example 7 | 1 | II | 1.47/1.41/1.40 | 6.7–9.1 | 1.5/1.4/1.6 | 0.2/0.5/0.7 | 0.03/0.06/0.07 |
| Example 8 | 5 | I | 1.43/1.40/1.40 | 6.9–8.9 | 1.5/1.5/1.6 | 0.2/0.3/0.4 | 0.02/0.03/0.05 |
| Example 9 | 6 | I | 1.50/1.45/1.52 | 6.5–9.4 | 1.5/1.4/1.6 | 0.2/0.3/0.4 | 0.02/0.04/0.06 |
| Example 10 | 7 | II | 1.43/1.40/1.41 | 6.8–8.5 | 1.4/1.5/1.4 | 0.2/0.3/0.4 | 0.02/0.02/0.05 |
| Example 11 | 8 | VII | 1.49/1.47/1.45 | 6.7–8.2 | 1.5/1.5/1.4 | 0.2/0.2/0.2 | 0.02/0.02/0.02 |
| Example 12 | 9 | VII | 1.44/1.41/1.40 | 6.5–8.3 | 1.5/1.4/1.4 | 0.2/0.3/0.4 | 0.02/0.02/0.03 |
| Comparative Example 4 | 10 | VII | 1.41/1.40/1.39 | 6.7–8.7 | 1.5/1.5/1.5 | 0.2/0.4/0.7 | 0.03/0.06/0.15 |
| Comparative Example 5 | 11 | VII | 1.50/1.40/1.35 | 6.0–9.8 | 1.5/1.3/1.6 | 0.2/0.5/1.0 | 0.02/0.05/0.12 |
| Example 13 | 12 | VII | 1.39/1.35/1.30 | 6.5–8.0 | 1.5/1.4/1.4 | 0.2/0.5/0.7 | 0.04/0.06/0.07 |
| Example 14 | 13 | VII | 1.41/1.39/1.37 | 6.5–8.3 | 1.5/1.4/1.4 | 0.2/0.3/0.6 | 0.02/0.04/0.06 |
| Comparative Example 6 | 14 | VII | 1.52/1.40/1.35 | 6.0–8.2 | 1.5/1.6/1.4 | 0.2/0.5/0.6 | 0.03/0.08/0.18 |
| Example 15 | 15 | VII | 1.52/1.48/1.47 | 7.1–8.9 | 1.5/1.5/1.6 | 0.2/0.4/0.5 | 0.03/0.05/0.07 |
| Example 16 | 16 | VII | 1.42/1.38/1.35 | 6.5–8.3 | 1.5/1.4/1.4 | 0.2/0.5/0.7 | 0.02/0.03/0.05 |
| Example 17 | 17 | VII | 1.43/1.42/1.42 | 7.3–8.2 | 1.5/1.5/1.5 | 0.2/0.5/0.5 | 0.02/0.05/0.05 |
| Example 18 | 8 | VIII | 1.42/1.40/1.35 | 6.5–8.2 | 1.5/1.4/1.4 | 0.2/0.5/0.7 | 0.02/0.04/0.07 |
| Comparative Example 7 | 8 | IX | 1.52/1.49/1.42 | 6.5–10.3 | 1.5/1.6/1.4 | 0.2/0.5/1.4 | 0.03/0.07/0.12 |
| Comparative Example 8 | 8 | X | 1.42/— | 8.0 | 1.6/— | 0.3/— | 0.05/— |

TABLE 3-continued

| | Toner | Carrier | Bulk density Initial/15000/30000 | Toner concentration (%) | Image density Initial/15000/30000 | Fog (%) Initial/15000/30000 | Solid image blurs Initial/15000/30000 |
|---|---|---|---|---|---|---|---|
| Example 19 | 8 | XI | 1.46/1.44/1.43 | 6.7–9.3 | 1.5/1.6/1.7 | 0.3/0.5/0.7 | 0.04/0.05/0.07 |
| Example 20 | 8 | XII | 1.45/1.41/1.39 | 6.9–8.9 | 1.5/1.4/1.4 | 0.2/0.3/0.3 | 0.03/0.05/0.05 |
| Example 21 | 8 | XIII | 1.52/1.50/1.48 | 6.8–8.9 | 1.5/1.5/1.4 | 0.2/0.3/0.3 | 0.02/0.02/0.03 |

The methods adopted for evaluation in Examples and Comparative Examples are as follows:

(1) Bulk Density

Bulk density of the developer was determined in accordance with the method for apparent density.

(2) Image Density

An original provided a circle having a diameter of 20 mm and an image density of 1.5 measured by a reflection density meter RD918 (made by McBeth Co.) was copied, and the image density of the image portion was measured by means of a reflection density meter RD918.

(3) Fog

Fog was measured by means of a REFLECTOMETER MODEL TC-6DS made by Tokyo Denshoku Co. using a amber filter, and fog was calculated in accordance with the following formula:

Fog(%)=Reflectance of standard paper (%)−Reflectance (%) of the non-image portion of the copied image (4) Solid Concentration Blur An original provided with five circles having a diameter of 20 mm and an image density of 1.5 measured by a reflection density meter RD918 (made by McBeth Co.) was copied, and the image density of the image portion was measured by means of a reflection density meter RD918. The difference between the highest and the lowest values was determined.

What is claimed is:

1. An image forming method, comprising:

a charging step of applying charge to a latent image bearing member;

a latent image forming step of forming an electrostatic latent image on said charged latent image bearing member;

a developing step of developing the electrostatic latent image by a developing means having a developer bearing member which bears and transfers a two-component type developer opposite to said latent image bearing member, and a magnetic field generator fixedly provided in said developer bearing member; and a controlling step of controlling a toner concentration of the two-component type developer by detecting a change in magnetic permeability of said two-component type developer by the use of inductance of a coil;

wherein said two-component type developer has a spherical magnetic powder dispersion type carrier in which at least a magnetic powder is dispersed in a binder resin, and a non-magnetic toner in which an external additive adheres to the surface of non-magnetic toner particles;

said spherical magnetic powder dispersion type carrier has a weight average particle diameter of from 15 to 60 μm;

said non-magnetic toner particles have a weight average particle diameter of from 2 to 9 μm;

said external additive is present on the toner particles and comprises (i) inorganic oxide fine particles (A), said inorganic oxide fine particles (A) having a shape factor SF-1 of from 100 to 130 and (ii) non-spherical inorganic oxide fine particles (B) having a shape factor SF-1 larger than 150 and particles (B) having been obtained by combining a plurality of component particles.

2. The image forming method according to claim 1, wherein particles of said inorganic oxide fine particles (A) have an average particle diameter of from 10 to 400 nm.

3. The image forming method according to claim 1, wherein particles of said inorganic oxide fine particles (A) have an average particle diameter of from 15 to 200 nm.

4. The image forming method according to claim 1, wherein particles of said inorganic oxide fine particles (A) have an average particle diameter of from 15 to 100 nm.

5. The image forming method according to claim 1, wherein said non-spherical inorganic oxide fine particles (B) have an average particle diameter of from 120 to 600 nm.

6. The image forming method according to claim 1, wherein at least 5 inorganic oxide fine particles (A) are present per non-magnetic toner particle surface area of 0.5 μm×0.5 μm, as observed in an enlarged electron microphotograph.

7. The image forming method according to claim 1, wherein at least 7 inorganic oxide fine particles (A) are present per non-magnetic toner particle surface area of 0.5 μm×0.5 μm, as observed in an enlarged electron microphotograph.

8. The image forming method according to claim 1, wherein at least 10 inorganic oxide fine particles (A) are present per non-magnetic toner particle surface area of 0.5 μm×0.5 μm, as observed in an enlarged electron microphotograph.

9. The image forming method according to claim 1, wherein from 1 to 30 fine particles of said non-spherical inorganic oxide (B) are present per area of 1.0 μm×1.0 μm of said non-magnetic toner particle surface, as observed in an enlarged electron microphotograph.

10. The image forming method according to claim 1, wherein from 1 to 25 fine particles of said non-spherical inorganic oxide (B) are present per area of 1.0 μm×1.0 μm of said non-magnetic toner particle surface, as observed in an enlarged electron microphotograph.

11. The image forming method according to claim 1, wherein from 5 to 25 fine particles of said non-spherical inorganic oxide (B) are present per area of 1.0 μm×1.0 μm of said non-magnetic toner particle surface, as observed in an enlarged electron microphotograph.

12. The image forming method according to claim 1, wherein said non-magnetic toner has inorganic oxide particles (A) in an amount of from 0.1 to 2 parts by weight relative to 100 parts by weight of the non-magnetic toner.

13. The image forming method according to claim 1, wherein said non-magnetic toner has inorganic oxide particles (A) in an amount of from 0.2 to 2 parts by weight relative to 100 parts by weight of the non-magnetic toner.

14. The image forming method according to claim 1, wherein said non-magnetic toner has inorganic oxide particles (A) in an amount of from 0.2 to 1.5 parts by weight relative to 100 parts by weight of the non-magnetic toner.

15. The image forming method according to claim 1, wherein said non-magnetic toner has non-spherical inorganic oxide fine particles (B) in an amount of from 0.3 to 3 parts by weight relative to 100 parts by weight of the non-magnetic toner.

16. The image forming method according to claim 1, wherein said non-magnetic toner has non-spherical inorganic oxide fine particles (B) in an amount of from 0.3 to 2.5 parts by weight relative to 100 parts by weight of the non-magnetic toner.

17. The image forming method according to claim 1, wherein said non-magnetic toner has non-spherical inorganic oxide fine particles (B) in an amount of from 0.3 to 2 parts by weight relative to 100 parts by weight of the non-magnetic toner.

18. The image forming method according to claim 1, wherein said non-magnetic toner has non-spherical inorganic oxide fine particles (B) in an amount of from 0.3 to 1.5 parts by weight relative to 100 parts by weight of the non-magnetic toner.

19. The image forming method according to claim 1, wherein said inorganic oxide fine particle (A) has at least one of titanium oxide and alumina.

20. The image forming method according to claim 1, wherein said non-spherical inorganic oxide particle (B) is silica.

21. The image forming method according to claim 1, wherein said inorganic oxide fine particles (A) have a BET specific surface area of from 60 to 230 $m^2/g$.

22. The image forming method according to claim 1, wherein said non-spherical inorganic fine particles (B) have a BET specific surface area of from 20 to 90 $m^2/g$.

23. The image forming method according to claim 1, wherein at least a part of said spherical magnetic power dispersion type carrier had been mixed with at least said external additive or another external additive prior to mixing with the non-magnetic toner.

24. The image forming method according to claim 1, wherein said spherical magnetic powder dispersion type carrier is manufactured by the polymerization process.

25. The image forming method according -to claim 1, wherein said spherical magnetic powder dispersion type carrier contains a phenol resin as a binder resin.

26. The image forming method according to claim 1, wherein said spherical magnetic powder dispersion type carrier has a non-magnetic metal oxide.

27. The image forming method according to claim 1, wherein said spherical magnetic powder dispersion type carrier comprises carrier core particles consisting of resin particles formed by dispersing magnetic powder particles and the surface thereof coated with a resin.

28. The image forming method according to claim 27, wherein the resin coating the surfaces of the carrier core particles is a silicone resin, a fluororesin or a copolymer or a mixture of a fluororesin and an acrylic resin.

29. The image forming method according to claim 1, wherein said spherical magnetic powder dispersion type carrier has a weight average particle diameter of from 20 to 60 $\mu$m.

30. The image forming method according to claim 1, wherein said spherical magnetic powder dispersion type carrier has a shape factor SF-1 of from 100 to 140.

31. The image forming method according to claim 1, wherein said spherical magnetic powder dispersion type carrier has a volume resistivity of from $10^9$ to $10^{15}$ $\Omega$cm.

32. The image forming method according to claim 1, wherein said non-magnetic toner particles are toner particles manufactured by the polymerization process.

33. The image forming method according to claim 1, wherein said non-magnetic toner particles have a core/shell structure.

34. The image forming method according to claim 1, wherein said non-magnetic toner particles have a shape factor SF-1 of from 100 to 140.

35. The image forming method according to claim 1, wherein said non-magnetic toner particles have a shape factor SF-2 of from 100 to 120.

36. The image forming method according to claim 1, wherein said non-magnetic toner particles have a weight average particle diameter of from 3 to 9 $\mu$m.

37. The image forming method according to claim 1, wherein said two-component type developer has an apparent density of from 1.2 to 2.0 $g/cm^3$.

38. The image forming method according to claim 1, wherein said two-component type developer has a degree of compression of from 5 to 19%.

39. The image forming method according to claim 1, wherein a developer regulating blade regulating the thickness of said two-component type developer borne by the developer bearing member is arranged below the developer bearing member.

40. The image forming method according to claim 1, wherein the charging member used in said charging step is a magnetic brush.

41. An image forming apparatus, comprising:

a latent image bearing member for bearing an electrostatic latent image;

charging means for applying charge to said latent image bearing member;

exposure means for forming an electrostatic latent image on said charged latent image bearing member;

developing means for developing said electrostatic latent image, having a developer bearing member for bearing and transferring a two-component type developer, opposite to said latent image bearing member, and a magnetic field generator fixedly provided in said developer bearing member; and toner concentration controlling means for controlling the toner concentration by detecting a change in magnetic permeability of said two-component type developer by the use of inductance of a coil;

wherein said two-component type developer has a spherical magnetic powder dispersion type carrier in which at least a magnetic powder is dispersed in a binder resin, and a non-magnetic toner in which an external additive adheres to the surface of said non-magnetic toner particles;

said spherical magnetic powder dispersion type carrier has a weight average particle diameter of from 15 to 60 $\mu$m;

said non-magnetic toner particles have a weight average particle diameter of from 2 to 9 $\mu$m;

said external additive is present on the toner particles and comprises (i) inorganic oxide fine particles (A), said inorganic oxide fine particles (A) having a shape factor SF-1 of from 100 to 130 and (ii) non-spherical inorganic oxide fine particles (B) having a shape factor SF-1 larger than 150 and particles (B) having been obtained by combining a plurality of component particles.

42. The image forming apparatus according to claim 41, wherein particles of said inorganic oxide fine particles (A) have an average particle diameter of from 10 to 400 nm.

43. The image forming apparatus according to claim 41, wherein particles of said inorganic oxide fine particles (A) have an average particle diameter of from 15 to 200 nm.

44. The image forming apparatus according to claim 41, wherein particles of said inorganic oxide fine particles (A) have an average particle diameter of from 15 to 100 nm.

45. The image forming apparatus according to claim 41, wherein said non-spherical inorganic oxide fine particles (B) have an average particle diameter of from 120 to 600 nm.

46. The image forming apparatus according to claim 41, wherein at least 5 inorganic oxide fine particles (A) are present per non-magnetic toner particle surface area of 0.5 $\mu$m×0.5 $\mu$m, as observed in an enlarged electron microphotograph.

47. The image forming apparatus according to claim 41, wherein at least 7 inorganic oxide fine particles (A) are present per non-magnetic toner particle surface area of 0.5 $\mu$m×0.5 $\mu$m, as observed in an enlarged electron microphotograph.

48. The image forming apparatus according to claim 41, wherein at least 10 inorganic oxide fine particles (A) are present per non-magnetic toner particle surface area of 0.5 $\mu$m×0.5 $\mu$m, as observed in an enlarged electron microphotograph.

49. The image forming apparatus according to claim 41, wherein from 1 to 30 fine particles of said non-spherical inorganic oxide (B) are present per area of 1.0 $\mu$m×1.0 $\mu$m of said non-magnetic toner particle surface, as observed in an enlarged electron microphotograph.

50. The image forming apparatus according to claim 41, wherein from 1 to 25 fine particles of said non-spherical inorganic oxide (B) are present per area of 1.0 $\mu$m×1.0 $\mu$m of said non-magnetic toner particle surface, as observed in an enlarged electron microphotograph.

51. The image forming apparatus according to claim 41, wherein from 5 to 25 fine particles of said non-spherical inorganic oxide (B) are present per area of 1.0 $\mu$m×1.0 $\mu$m of said non-magnetic toner particle surface, as observed in an enlarged electron microphotograph.

52. The image forming apparatus according to claim 41, wherein said non-magnetic toner has inorganic oxide particles A in an amount of from 0.1 to 2 parts by weight relative to 100 parts by weight of the non-magnetic toner.

53. The image forming apparatus according to claim 41, wherein said non-magnetic toner has inorganic oxide particles A in an amount of from 0.2 to 2 parts by weight relative to 100 parts by weight of the non-magnetic toner.

54. The image forming apparatus according to claim 41, wherein said non-magnetic toner has inorganic oxide particles A in an amount of from 0.2 to 1.5 parts by weight relative to 100 parts by weight of the non-magnetic toner.

55. The image forming apparatus according to claim 41, wherein said non-magnetic toner has non-spherical inorganic oxide fine particles (B) in an amount of from 0.3 to 3 parts by weight relative to 100 parts by weight of the non-magnetic toner.

56. The image forming apparatus according to claim 41, wherein said non-magnetic toner has non-spherical inorganic oxide fine particles (B) in an amount of from 0.3 to 2.5 parts by weight relative to 100 parts by weight of the non-magnetic toner.

57. The image forming apparatus according to claim 41, wherein said non-magnetic toner has non-spherical inorganic oxide fine particles (B) in an amount of from 0.3 to 2 parts by weight relative to 100 parts by weight of the non-magnetic toner.

58. The image forming apparatus according to claim 41, wherein said non-magnetic toner has non-spherical inorganic oxide fine particles (B) in an amount of from 0.3 to 1.5 parts by weight relative to 100 parts by weight of the non-magnetic toner.

59. The image forming apparatus according to claim 41, wherein said inorganic oxide fine particle (A) has at least one of titanium oxide and alumina.

60. The image forming apparatus according to claim 41, wherein said non-spherical inorganic oxide particle (B) is silica.

61. The image forming apparatus according to claim 41, wherein said inorganic oxide fine particles (A) have a BET specific surface area of from 60 to 230 $m^2/g$.

62. The image forming apparatus according to claim 41, wherein said non-spherical inorganic fine particles B have a BET specific surface area of from 20 to 90 $m^2/g$.

63. The image forming apparatus according to claim 41, wherein at least a part of said spherical magnetic powder dispersion type carrier has been mixed with at least said external additive or another external additive prior to mixing with the non-magnetic toner.

64. The image forming apparatus according to claim 41, wherein said spherical magnetic powder dispersion type carrier is manufactured by the polymerization process.

65. The image forming apparatus according to claim 41, wherein said spherical magnetic powder dispersion type carrier contains a phenol resin as a binder resin.

66. The image forming apparatus according to claim 41, wherein said spherical magnetic powder dispersion type carrier has a non-magnetic metal oxide.

67. The image forming apparatus according to claim 41, wherein said spherical magnetic powder dispersion type carrier comprises carrier core particles consisting of resin particles formed by dispersing magnetic powder particles and the surface thereof coated with a resin.

68. The image forming apparatus according to claim 41, wherein the resin coating the surfaces of the carrier core particles is a silicone resin, a fluororesin or a copolymer or a mixture of a fluororesin and an acrylic resin.

69. The image forming apparatus according to claim 41, wherein said spherical magnetic powder dispersion type carrier has a weight average particle diameter of from 20 to 60 $\mu$m.

70. The image forming apparatus according to claim 41, wherein said spherical magnetic powder dispersion type carrier has a shape factor SF-1 of from 100 to 140.

71. The image forming apparatus according to claim 41, wherein said spherical magnetic powder dispersion type carrier has a volume resistivity of from $10^9$ to $10^{10}$ Ωcm.

72. The image forming apparatus according to claim 41, wherein said non-magnetic toner particles are toner particles manufactured by the polymerization process.

73. The image forming apparatus according to claim 41, wherein said non-magnetic toner particles have a core/shell structure.

74. The image forming apparatus according to claim 41, wherein said non-magnetic toner particles have a shape factor SF-1 of from 100 to 140.

75. The image forming apparatus according to claim 41, wherein said non-magnetic toner particles have a shape factor SF-2 of from 100 to 120.

76. The image forming apparatus according to claim 41, wherein said non-magnetic toner particles have a weight average particle diameter of from 3 to 9 $\mu$m.

77. The image forming apparatus according to claim 41, wherein said two-component type developer has an apparent density of from 1.2 to 2.0 $g/cm^3$.

78. The image forming apparatus according to claim 41, wherein said two-component type developer has a degree of compression of from 5 to 19%.

79. The image forming apparatus according to claim 41, wherein a developer regulating blade regulating the thickness of said two-component type developer borne by the developer bearing member is arranged below the developer bearing member.

80. The image forming apparatus according to claim 41, wherein said charging means is a magnetic brush.

81. The image forming method according to claim 1, wherein inorganic oxide fine particles (A) are present on the toner particles in a form of primary particles.

82. The image forming method according to claim 1, wherein inorganic oxide fine particles (A) are present on the toner particles in a form of secondary particles.

83. The image forming method according to claim 41, wherein inorganic oxide fine particles (A) are present on the toner particles in a form of primary particles.

84. The image forming method according to claim 41, wherein inorganic oxide fine particles (A) are present on the toner particles in a form of secondary particles.

* * * * *

UNITED STATES PATENT AND TRADEMARK OFFICE

CERTIFICATE OF CORRECTION

PATENT NO. : 6,137,977
DATED : October 24, 2000
INVENTOR(S) : Kenji Okado et al.

It is certified that error appears in the above-identified patent and that said Letters Patent is hereby corrected as shown below:

Title page,
Item [54] "IMAGE FORMING METHOD AND IMAGE FORMING APPARATUS USING SPECIFIC DEVELOPER COMPOSITION" should read -- IMAGE FORMING METHOD AND APPARATUS USING DEVELOPER CONTAINING SPHERICAL MAGNETIC POWDER AS CARRIER AND NON-MAGNETIC TONER --.
Item [56] "32060 3/1980 should read -- 55-30260 3/1980 --;
"165082 9/1984 should read -- 59-165082 9/1984 --;
"124677 4/1992 should read -- 4-124677 4/1992 --.
Item [57]
Line 9, "particles B" should be deleted.

Column 1, Title,
"IMAGE FORMING METHOD AND IMAGE FORMING APARATUS USING SPECIFIC DEVELOPER COMPOSITON" should read -- IMAGE FORMING METHOD AND APPARATUS USING DEVELOPER CONTAINING SPHERICAL MAGNETIC POWER AS CARRIER AND NON-MAGNETIC TONER --;
Line 10, "apprawhich" should read -- which --;
Line 53, "having displaced" should read -- having been displaced.

Column 1,
Line 10, "apprawhich" should read -- which --;
Line 53, "having displaced" should read -- having been displaced.

Column 2,
Line 58, "mainly the" should read -- mainly by the --.

Column 3,
Line 21, "According as" should read -- Accordingly as --.

Column 5,
Line 44, "commoners" should read -- comonomers -- and "used to a" should read -- include -- and "monomer a" should read -- monomer, a --;
Line 48, "acide-2-" should read -- acid-2- --;
Line 64, "ethylenebglycoldimethacrylate," should read -- ethyleneglycoldimethacrylate, --;
Line 67, "sufon;" should read -- sulfon; --.

Column 6,
Line 35, "temperature set" should read -- temperature is set --.

UNITED STATES PATENT AND TRADEMARK OFFICE

CERTIFICATE OF CORRECTION

PATENT NO. : 6,137,977
DATED : October 24, 2000
INVENTOR(S) : Kenji Okado et al.

It is certified that error appears in the above-identified patent and that said Letters Patent is hereby corrected as shown below:

Column 7,
Line 8, "disturbing" should read -- distributing the --;
Line 15, "with-a" should read -- with a --;
Line 20, "caster oil," should read -- castor oil, --;
Line 41, "acrylat," should read -- acrylate, --;
Line 56, "is terns" should read -- in terms --.

Column 8,
Line 5, "them," should read -- then --;
Line 32, "set" should read -- bet set --;
Line 62, "is" should read -- which is --;
Line 64, "it stained" should read -- is stained --;
Line 65, "simultaneous" should read -- simultaneously.

Column 9,
Line 13, "structured." should read -- structure. --;
Line 50, "make" should read -- makes --;
Line 52, "ones" should be deleted;
Line 54, "carrier of between" -- carrier between --;
Line 67, "and is" should read -- and be --.

Column 10,
Line 21, "not" should read -- not, --;
Line 22, "however" should read -- however, --;
Line 38, "luroyl" should read -- lauroyl --.

Column 11,
Line 21, "plexes" should read -- plexes, --;
Line 27, "compounds" should read -- compounds, --;
Line 43, "of from" should read -- from --;
Line 60, "include" should read -- includes --.

Column 12,
Line 27, "preferable" should read -- preferably --;
Line 45, "high-quality" should read -- high quality -- and "high-" should read -- high --.

Column 13,
Line 29, "whatever the" should read -- whatever --;
Line 32, "has a" should read -- have -- and "diameter." should read -- diameters. --;
Line 60, "high-vascosity" should read -- high-viscosity --.

UNITED STATES PATENT AND TRADEMARK OFFICE

CERTIFICATE OF CORRECTION

PATENT NO. : 6,137,977
DATED : October 24, 2000
INVENTOR(S) : Kenji Okado Et Al.

It is certified that error appears in the above-identified patent and that said Letters Patent is hereby corrected as shown below:

Column 14,
Line 7, "vinylgroup," should read -- vinyl group, --;
Line 9, "fQr" should read -- for --.

Column 15,
Line 12, "comprising" should read -- comprise --.

Column 16,
Line 62, "along" should read a long --.

Column 17,
Line 21, "additive" should read -- additives --.

Column 19,
Line 29, "stabilizer" should read -- stabilizers --;
Line 57, "liquidus" should read -- liquid --;
Line 60, "them" should read -- then -- and "there is" should read -- there are --.

Column 20,
Line 4, "arylic" should read -- acrylic --;
Line 13, "particle" should read -- particles --;
Line 15, "particle" should read -- particles --;
Line 17, "dissolved" should read -- dissolving --;
Line19, "particle" should read -- particles --;
Line 30, "can not be should read -- cannot --;
Line 31, "well taken place," should read -- take place -- and "hereby" should read -- thereby --.

Column 21,
Line 21, "adhering," should read -- adhering --;
Line 50, "ally," should read -- alloy, --;
Line 53, "ploymer," should read -- polymer, --.

UNITED STATES PATENT AND TRADEMARK OFFICE

CERTIFICATE OF CORRECTION

PATENT NO. : 6,137,977
DATED : October 24, 2000
INVENTOR(S) : Kenji Okado et al.

It is certified that error appears in the above-identified patent and that said Letters Patent is hereby corrected as shown below:

Column 22,
Line 35, "a resins" should read -- resins --;
Line 42, "support" should read -- support, --;
Line 60, "when exposure." should read -- when exposed. --;
Line 61, "used the" should read -- used in the --.

Column 25,
Line 21, "may be to" should read -- may be carried to --;
Line 34, "member" should read -- members --;
Line 37, "member" should read -- members --;
Line 50, "as instance," should read -- an instance, --;
Line 59, "in an" should read -- in a --;
Line 64, "leak" should read -- leakage --;
Line 65, "charging" should read -- the charging --.

Column 26,
Line 58, "is no formed" should read -- is not formed --.

Column 27,
Line 16, "stationaily" should read -- stationarily --;
Line 54, "image members" should read -- image bearing member --.

Column 28,
Line 19, "for the" should read -- for --;
Line 26, "may more hardly occur" should read -- may hardly occur --;
Line 40, "according" should read -- accordingly --;
Line 55, "ant to attract" should read -- acts --.

Column 29,
Line 44, "according" should read -- accordingly --;
Line 48, "according" should read -- accordingly --.

Column 30,
Page 18, "charge" should read -- charged --.

Column 31,
Page 43, "such problems" should read -- problems such --.

UNITED STATES PATENT AND TRADEMARK OFFICE

CERTIFICATE OF CORRECTION

PATENT NO. : 6,137,977
DATED : October 24, 2000
INVENTOR(S) : Kenji Okado et al.

It is certified that error appears in the above-identified patent and that said Letters Patent is hereby corrected as shown below:

Column 32,
Page 55, "decrease" should read -- decreases --;
Page 66, "unit pa" should read -- unit Pa --.

Column 33,
Page 19, "image" should read -- images --;
Page 60, "force" should read -- forces --;
Page 64, "sieve" should read -- a sieve --.

Column 34,
Page 15, "on the" should read -- of the --.

Column 35,
Page 5, "B was" should read -- B were --;
Page 29, "(30mmX" should read -- (30 mmX --.

Column 36,
Page 9, "cell; $2cm^2$; should read -- cell: $2cm^2$; --.

Column 37,
Page 51, "After cooled," should read -- After being cooled --;

Column 38,
Line 9, " SF-1" should read -- An SF-1 --;
Line 10, "production" should read -- Production --.

Column 40,
Table 1, "BET surface" should read -- BET specific --.

Column 41,
Table 1, "BET surface" should read -- BET specific --.

Column 42,
Line 43, "SF-2" should read -- an SF-2 --.

Column 43,
Line 28,"40 aprts" should read -- 40 parts --.

UNITED STATES PATENT AND TRADEMARK OFFICE

CERTIFICATE OF CORRECTION

PATENT NO. : 6,137,977
DATED : October 24, 2000
INVENTOR(S) : Kenji Okado et al.

It is certified that error appears in the above-identified patent and that said Letters Patent is hereby corrected as shown below:

Column 44,
Line 52, "8X1012 Ωcm," should read -- $8x10^{12}$ Ωcm, --.

Column 45,
Line 41, "member production" should read -- Member Production --;

Column 46,
Line 32, "phtocurable" should read -- photocurable --;
Line 43, "pbtained" should read -- obtained --.

Column 47,
Line 34, "was however" should read -- was, however, --;
Line 49, "a satisfactory" should read -- satisfactory --.

Column 48,
Line 36, "Satisfactory" should read -- A satisfactory --.

Column 49,
Line 2, "become" should read -- became --;
Line 13, "where as" should reas -- whereas --;
Line 25, "resulting" should read -- resulting in --;
Line 48, "satisfactory" should read -- a satisfactory --;
Line 67, "satisfactory" should read -- The results were satisfactory --.

Column 51,
Line 11, "The carrier" should read -- Although the carrier --;
Line 37, "and thus" should read -- thus --.

Column 52,
Line 28, "An yellow" should read -- A yellow --;
Line 31, "was changed." should read were -- changed. -- and "Using these" should read -- These --.

Column 55,
Line 36, "power" should read -- powder --;
Line 43, "-to" should read -- to --.

UNITED STATES PATENT AND TRADEMARK OFFICE

CERTIFICATE OF CORRECTION

PATENT NO. : 6,137,977
DATED : October 24, 2000
INVENTOR(S) : Kenji Okado et al.

It is certified that error appears in the above-identified patent and that said Letters Patent is hereby corrected as shown below:

Column 57,
Line 41, "ticles A" should read -- ticles (A) --;
Line 45, "ticles A" should read -- ticles (A) --;
Line 49, "ticles A" should read -- ticles (A) --.

Column 58,
Line 13, "particles B" should read -- particles (B) -- .

Column 60,
Line 4, "method" should read -- apparatus --;
Line 7, "method" should read -- apparatus --.

Signed and Sealed this

Sixth Day of October, 2001

*Attest:*

Nicholas P. Godici

NICHOLAS P. GODICI
*Acting Director of the United States Patent and Trademark Office*

*Attesting Officer*